US011569585B2

(12) United States Patent
Li et al.

(10) Patent No.: US 11,569,585 B2
(45) Date of Patent: Jan. 31, 2023

(54) HIGHLY INTEGRATED PATTERN-VARIABLE MULTI-ANTENNA ARRAY

(71) Applicant: Industrial Technology Research Institute, Hsinchu (TW)

(72) Inventors: Wei-Yu Li, Yilan County (TW); Wei Chung, Hsinchu County (TW); Kin-Lu Wong, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 273 days.

(21) Appl. No.: 17/137,362

(22) Filed: Dec. 30, 2020

(65) Prior Publication Data

US 2022/0209420 A1 Jun. 30, 2022

(51) Int. Cl.

*H01Q 21/06* (2006.01)
*H01Q 9/42* (2006.01)
*H01Q 1/48* (2006.01)

(52) U.S. Cl.

CPC ..... *H01Q 21/06* (2013.01); *H01Q 1/48* (2013.01); *H01Q 9/42* (2013.01)

(58) Field of Classification Search

CPC ..... H01Q 21/06; H01Q 21/28; H01Q 1/50; H01Q 21/062; H01Q 21/29; H01Q 5/385–392; H01Q 5/321; H01Q 5/378

See application file for complete search history.

(56) References Cited

U.S. PATENT DOCUMENTS 5,231,413 A 7/1993 Dubois
5,235,343 A 8/1993 Audren et al.
(Continued)

FOREIGN PATENT DOCUMENTS

TW 201810802 3/2018
TW 201824647 7/2018
(Continued)

OTHER PUBLICATIONS

"Office Action of Taiwan Counterpart Application", dated Jul. 14, 2021, p. 1-p. 6.

Ta-Chun Pu, et al., "A novel antenna pattern switching mechanism for WLAN application", 2011 IEEE International Symposium on Antennas and Propagation (APSURSI) ,Jul. 3-8, 2011, pp. 2051-2054.

Wei-Yu Li et al., "Multiband 4-port MIMO antenna system for LTE700/2300/2500 operation in the laptop computer", 2012 Asia Pacific Microwave Conference Proceedings, Dec. 4-7, 2012, pp. 1163-1165.

(Continued)

*Primary Examiner* — Ricardo I Magallanes
(74) *Attorney, Agent, or Firm* — JCIPRNET

(57) ABSTRACT

A highly integrated pattern-variable multi-antenna array, including a ground conductor structure, a first antenna array, a second antenna array, and an array conjoined grounding structure, is provided. A first inverted L-shaped resonant structure has a first feeding point, and the others respectively have a first switch and are electrically connected or coupled to the ground conductor structure. A second inverted L-shaped resonant structure has a second feeding point, and the others respectively have a second switch and are electrically connected or coupled to the ground conductor structure. The first and second antenna arrays respectively generate first and second resonance modes. The second and first resonance modes cover at least one same first communication frequency band. The array conjoined grounding structure electrically connects an adjacent first inverted L-shaped resonant structure, one of the second inverted L-shaped resonant structures, and has an array conjoined capacitive structure electrically connecting the ground conductor structure.

31 Claims, 23 Drawing Sheets

(56) References Cited

U.S. PATENT DOCUMENTS

| | | | | |
|---|---|---|---|---|
| 6,211,830 | B1 | 4/2001 | Monma et al. | |
| 6,959,209 | B2 | 10/2005 | Fang | |
| 6,987,493 | B2 | 1/2006 | Chen | |
| 7,034,761 | B2 | 4/2006 | Chiang et al. | |
| 7,525,486 | B2 | 4/2009 | Shtrom et al. | |
| 7,911,402 | B2 | 3/2011 | Rowson et al. | |
| 9,077,084 | B2 | 7/2015 | Li et al. | |
| 9,472,841 | B2 | 10/2016 | Wong et al. | |
| 9,543,648 | B2 | 1/2017 | Cheng et al. | |
| 9,559,422 | B2 | 1/2017 | Wong et al. | |
| 9,871,284 | B2 | 1/2018 | Piazza et al. | |
| 2005/0174294 | A1 | 8/2005 | Peroulis et al. | |
| 2008/0258992 | A1* | 10/2008 | Tsai | H01Q 21/28 343/853 |
| 2010/0295743 | A1 | 11/2010 | Pu et al. | |
| 2013/0257674 | A1* | 10/2013 | Li | H01Q 9/42 343/853 |
| 2015/0061962 | A1* | 3/2015 | Lee | H01Q 9/42 343/893 |
| 2015/0116153 | A1 | 4/2015 | Chen et al. | |
| 2016/0093951 | A1 | 3/2016 | Schmid | |
| 2021/0151871 | A1* | 5/2021 | Lyu | H01Q 1/521 |
| 2021/0376459 | A1* | 12/2021 | Li | H01Q 9/42 |

FOREIGN PATENT DOCUMENTS

| | | |
|---|---|---|
| TW | 201926801 | 7/2019 |
| TW | I668968 | 8/2019 |

OTHER PUBLICATIONS

Jui-Hung Chen, et al., "A novel antenna beam switching technique on mobile devices for MIMO applications", 2012 Asia Pacific Microwave Conference Proceedings, Dec. 4-7, 2012, Jan. 28, 2013, pp. 1079-1081.

Ta-Chun Pu, et al. , "Compact beam-switching antenna with shaped ground for MIMO application" 2013 IEEE Antennas and Propagation Society International Symposium (APSURSI), Jul. 7-13, 2013, pp. 1334-1335.

Hyunseong Kang, et al., "Electric and magnetic loop mode pattern switchable antenna", 2012 International Symposium on Antennas and Propagation (ISAP), Oct. 29-Nov. 2, 2012, pp. 1337-1340.

Wei Lin, et al., "Wideband Pattern-Reconfigurable Antenna With Switchable Broadside and Conical Beams", IEEE Antennas and Wireless Propagation Letters (vol. 16), Aug. 11, 2017, pp. 2638-2641.

S. V. Shynu Nair, et al., "Reconfigurable Antenna With Elevation and Azimuth Beam Switching" IEEE Antennas and Wireless Propagation Letters (vol. 9), Apr. 29, 2010, pp. 367-370.

Shu-Lin Chen, et al., "Pattern-Reconfigurable Antenna With Five Switchable Beams in Elevation Plane" IEEE Antennas and Wireless Propagation Letters (vol. 17, Issue: 3), Jan. 18, 2018, pp. 454-457.

Seung-Hyun Eom, et al., "Paper-based pattern switchable antenna using inkjet-printing technology", 2015 Asia-Pacific Microwave Conference (APMC), Dec. 6-9, 2015, pp. 1-3.

M. S. Alam, et al., "Wideband Pattern-Reconfigurable Antenna Using Pair of Radial Radiators on Truncated Ground With Switchable Director and Reflector", IEEE Antennas and Wireless Propagation Letters (vol. 16), Apr. 11, 2016, pp. 24-28.

* cited by examiner

HIGHLY INTEGRATED PATTERN-VARIABLE MULTI-ANTENNA ARRAY

BACKGROUND

Technical Field

The disclosure relates to an integrated multi-antenna design, and more particularly relates to an integrated pattern-variable multi-antenna array design framework.

Description of Related Art

Due to the requirements of improvement on signal quality and transmission data rate of wireless communication, multi-input multi-output (MIMO) multi-antenna technologies are rapidly developed. The MIMO multi-antenna technologies could have opportunities for improving spectrum efficiency, increasing channel capacity and transmission data rates, and could have opportunities for improving receiving signal reliability of wireless communication through properly arranging multi-antenna configurations. Besides, since beamforming antenna array technologies with a characteristic of radiation pattern variation could have opportunities to reduce destructive interference between different wireless communication data streams in a same frequency band by generating diversified directivities of radiation beams, the beamforming antenna array technology and the MIMO multi-antenna technology have become a development focus of next generation Multi-Gbps communication systems.

Nowadays, many beamforming antenna array architectures and MIMO multi-antenna technologies have been published. However, how to successfully integrate technical functions of two different architectures of beamforming antenna array and MIMO multi-antenna technology, and meanwhile achieve features of high integration, good matching, and interference reduction when environment changes of wireless communication channels would be a technical challenge that is not easy to overcome, and it is also an important subject to be solved at present. Since a pattern switching mechanism of many beamforming antenna array architectures would be easy to cause interference of near-field coupling energy on the MIMO multi-antenna systems, a design method that may satisfy the above considerations is required to fulfill practical application requirements of multi-antenna communication devices or equipment with high data transmission rate in the future.

SUMMARY

An embodiment of the disclosure is directed to a highly integrated pattern-variable multi-antenna array, and some exemplary embodiments satisfy the above-mentioned technical considerations.

In an exemplary embodiment, the disclosure provides a highly integrated pattern-variable multi-antenna array. The highly integrated pattern-variable multi-antenna array includes a ground conductor structure, a first antenna array, a second antenna array, and an array conjoined grounding structure. The first antenna array includes a plurality of first inverted L-shaped resonant structures. Each of the first inverted L-shaped resonant structures has a first resonance path. One of the first inverted L-shaped resonant structures has a first feeding point, and each of the other first inverted L-shaped resonant structures respectively has a first switch and is electrically connected or coupled to the ground conductor structure. The first switch has a first switch center point. The first antenna array generates a first resonance mode. The second antenna array includes a plurality of second inverted L-shaped resonant structures. Each of the second inverted L-shaped resonant structures has a second resonance path, one of the second inverted L-shaped resonant structures has a second feeding point, and each of the other second inverted L-shaped resonant structures respectively has a second switch, and is electrically connected or coupled to the ground conductor structure. The second switch has a second switch center point. The second antenna array generates a second resonance mode. The second resonance mode and the first resonance mode cover at least one identical first communication frequency band. The array conjoined grounding structure has an array conjoined capacitive structure, and electrically connects to adjacent one of the first inverted L-shaped resonant structures, one of the second inverted L-shaped resonant structures, and the ground conductor structure.

To make the aforementioned more comprehensible, several embodiments accompanied with drawings are described in detail as follows.

BRIEF DESCRIPTION OF THE DRAWINGS

FIG. 3C is a 2D radiation pattern curve diagram of the highly integrated pattern-variable multi-antenna array 3 under a condition that a first switch 3123 is turned on, a first switch 3133 is turned on, a second switch 3223 is turned on and a second switch 3233 is turned on.

FIG. 3E is a 2D radiation pattern curve diagram of the highly integrated pattern-variable multi-antenna array 3 under a condition that the first switch 3123 is turned off, the first switch 3133 is turned off, the second switch 3223 is turned on and the second switch 3233 is turned on.

FIG. 3G is a 2D radiation pattern curve diagram of the highly integrated pattern-variable multi-antenna array 3 under a condition that the first switch 3123 is turned off, the first switch 3133 is turned off, the second switch 3223 is turned off and the second switch 3233 is turned on.

FIG. 3I is a 2D radiation pattern curve diagram of the highly integrated pattern-variable multi-antenna array 3 under a condition that the first switch 3123 is turned off, the first switch 3133 is turned on, the second switch 3223 is turned off and the second switch 3233 is turned on.

FIG. 4C is a 2D radiation pattern curve diagram of the highly integrated pattern-variable multi-antenna array 4 under a condition that a first switch 4123 is turned on, a first switch 4133 is turned on, a second switch 4223 is turned on and a second switch 4233 is turned on.

FIG. 4D is a 2D radiation pattern curve diagram of the highly integrated pattern-variable multi-antenna array 4 under a condition that the first switch 4123 is turned on, the first switch 4133 is turned off, the second switch 4223 is turned on and the second switch 4233 is turned on.

FIG. 4G is a 2D radiation pattern curve diagram of the highly integrated pattern-variable multi-antenna array 4 under a condition that the first switch 4123 is turned on, the first switch 4133 is turned off, the second switch 4223 is turned off and the second switch 4233 is turned on.

FIG. 4I is a 2D radiation pattern curve diagram of the highly integrated pattern-variable multi-antenna array 4 under a condition that the first switch 4123 is turned off, the first switch 4133 is turned off, the second switch 4223 is turned on and the second switch 4233 is turned on.

DESCRIPTION OF THE EMBODIMENTS

Figure 1:
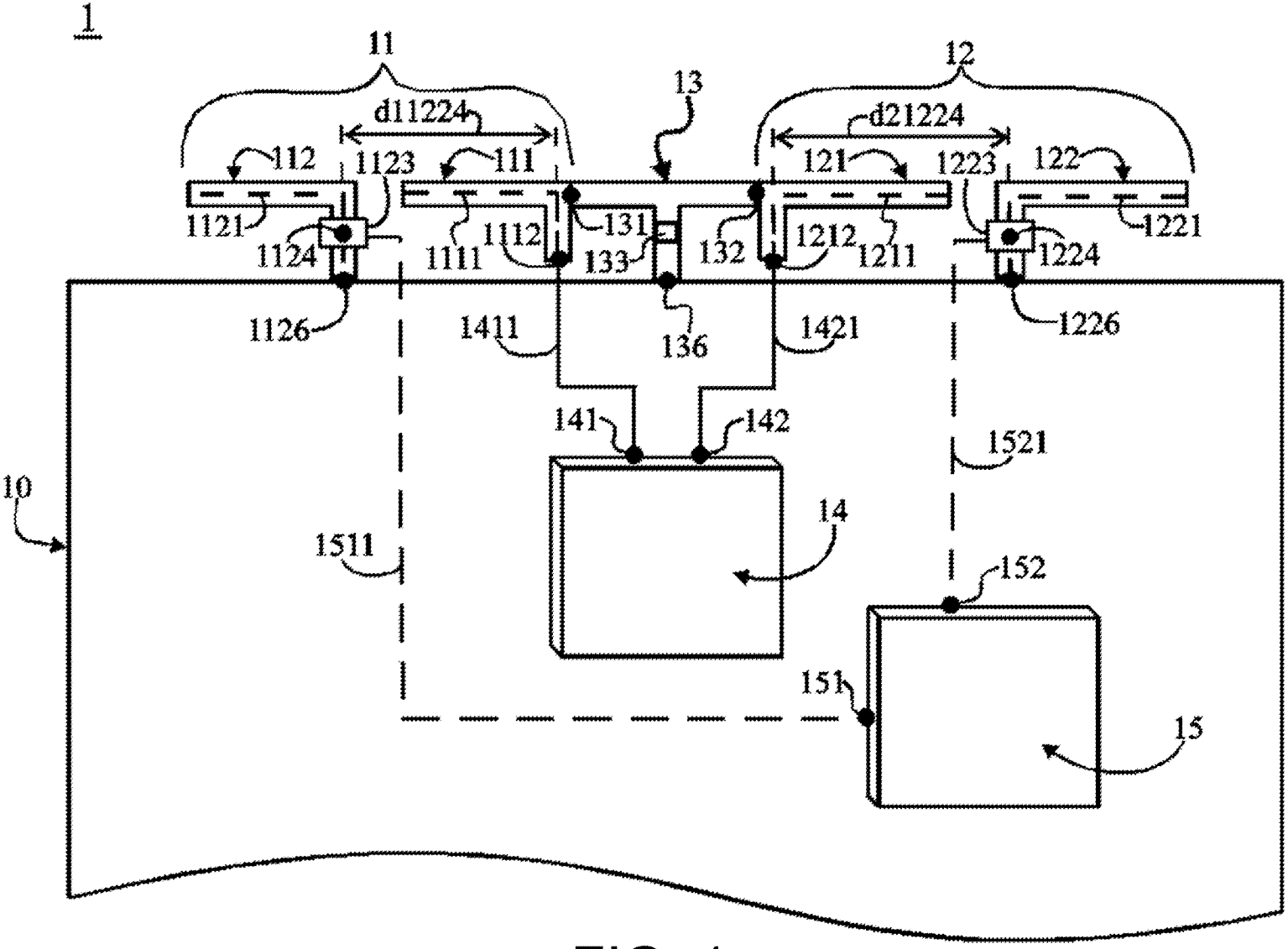
FIG. 1 is a structural diagram of a highly integrated pattern-variable multi-antenna array 1 according to an embodiment of the disclosure.

The disclosure provides a highly integrated pattern-variable multi-antenna array. The highly integrated pattern-variable multi-antenna array includes a ground conductor structure, a first antenna array, a second antenna array, and an array conjoined grounding structure. The first antenna array includes a plurality of first inverted L-shaped resonant structures. Each of the first inverted L-shaped resonant structures has a first resonance path. One of the first inverted L-shaped resonant structures has a first feeding point, and each of the other first inverted L-shaped resonant structures respectively have a first switch and are electrically connected or coupled to the ground conductor structure. The first switch has a first switch center point. The first antenna array generates a first resonance mode. The second antenna array includes a plurality of second inverted L-shaped resonant structures. Each of the second inverted L-shaped resonant structures has a second resonance path, one of the second inverted L-shaped resonant structures has a second feeding point, and each of the other second inverted L-shaped resonant structures respectively have a second switch, and are electrically connected or coupled to the ground conductor structure. The second switch has a second switch center point. The second antenna array generates a second resonance mode. The second resonance mode and the first resonance mode cover at least one identical first communication frequency band. The array conjoined grounding structure has an array conjoined capacitive structure, and electrically connects to adjacent one of the first inverted L-shaped resonant structures, one of the second inverted L-shaped resonant structures, and the ground conductor structure.

In order to successfully achieve the technical effects of miniaturization, high integration, diversified radiation pattern variations, and multi-stream high data rate communication, in the highly integrated pattern-variable multi-antenna array provided by the disclosure, by designing the first inverted L-shaped resonant structure to have the first switch and to be electrically connected to the ground conductor structure, and designing the second inverted L-shaped resonant structure to have the second switch and to be electrically connected to the ground conductor structure, and changing the first switch and the second switch between different turn-on and turn-off state combinations, the effect of controlling the radiation pattern variations of the first antenna array and the second antenna array could be successfully achieved. By designing the array conjoined grounding structure to have the array conjoined capacitive structure, and to electrically connect adjacent one of the first inverted L-shaped resonant structures, one of the second inverted L-shaped resonant structures, and the ground conductor structure, an overall size of the first antenna array and the second antenna array is successfully reduced, and a mutual coupling effect between the first antenna array and the second antenna array could be successfully reduced, and the mutual interference of the first switch and the second switch under different turn-on and turn-off state combinations would be reduced, so as to successfully achieve the effect of generating diversified radiation patterns. Therefore, the highly integrated pattern-variable multi-antenna array 1 provided by the disclosure could successfully achieve the technical effects of miniaturization, high integration, diversified radiation pattern variations, and multi-stream high-data-rate communication.

FIG. 1 is a structural diagram of the highly integrated pattern-variable multi-antenna array 1 according to an embodiment of the disclosure. As shown in FIG. 1, the highly integrated pattern-variable multi-antenna array 1 includes a ground conductor structure 10, a first antenna array 11, a second antenna array 12, and an array conjoined grounding structure 13. The first antenna array 11 includes a plurality of first inverted L-shaped resonant structures 111 and 112. The first inverted L-shaped resonant structures 111 and 112 respectively have first resonance paths 1111, 1121. One of the first inverted L-shaped resonant structures 111 has a first feeding point 1112, and the other first inverted L-shaped resonant structure 112 has a first switch 1123 and is electrically connected or coupled to the ground conductor structure 10, and has an electrical connection point 1126. The first switch 1123 has a first switch center point 1124. The first antenna array 11 generates a first resonance mode. The second antenna array 12 includes a plurality of second inverted L-shaped resonant structures 121 and 122. The second inverted L-shaped resonant structures 121 and 122 respectively have second resonance paths 1211, 1221, one of the second inverted L-shaped resonant structures 121 has a second feeding point 1212, and the other second inverted L-shaped resonant structure 122 has a second switch 1223, and is electrically connected or coupled to the ground conductor structure 10, and has an electrical connection point 1226. The second switch 1223 has a second switch center point 1224. The second antenna array 12 generates a second resonance mode. The second resonance mode and the first resonance mode cover at least one identical first communication frequency band. The array conjoined grounding structure 13 has an array conjoined capacitive structure 133, and is electrically connected to the adjacent first inverted L-shaped resonant structure 111, the adjacent second inverted L-shaped resonant structure 121, and the ground conductor structure 10. The first inverted L-shaped resonant structure 111 has the first feeding point 1112, and the second inverted L-shaped resonant structure 121 has the second feeding point 1212. The array conjoined grounding structure 13 has electrical connection points 131, 132, 136. The array conjoined capacitive structure 133 is a lumped capacitive element or a chip capacitive element. The first inverted L-shaped resonant structures 111 and 112 or the second inverted L-shaped resonant structures 121 and 122 could also have partial turning or meandering sections to adjust an impedance matching level of the first resonance mode and the second resonance mode.

There is a first distance d11224 between the first feeding point 1112 and the adjacent first switch center point 1124, and the first distance d11224 is between 0.05 wavelength and 0.6 wavelength of the lowest operating frequency of the first communication frequency band. There is a third distance d21224 between the second feeding point 1212 and the adjacent second switch center point 1224, and the third distance d21224 is between 0.05 wavelength and 0.6 wavelength of the lowest operating frequency of the first communication frequency band. The length of each of the first resonance paths 1111 and 1121 is between 0.1 wavelength and 0.5 wavelength of the lowest operating frequency of the first communication frequency band. The length of each of the second resonance paths 1211 and 1221 is between 0.1 wavelength and 0.5 wavelength of the lowest operating frequency of the first communication frequency band. The first switch 1123 and the second switch 1223 could be respectively a diode switch, a mechanical switch, a semiconductor switch, a radio frequency switch, a microelectromechanical switch or a chip switch. The first feeding point 1112 and the second feeding point 1212 are electrically connected or coupled to a first circuit 14 through respective first transmission lines 1411, 1421, and have electrical connection points 141, 142. The first transmission lines 1411, 1421 could be respectively a radio frequency transmission line, a coaxial transmission line, a microstrip transmission line, a flat-plate transmission line or a strip line. The first circuit 14 could be a power combining circuit, a phase control circuit, a frequency up/down-conversion circuit, an impedance matching circuit, an amplifier module, an integrated circuit chip, a radio frequency module or a multi-input multi-output transceiver module. The first switch 1123 and the second switch 1223 are electrically connected or coupled to a second circuit 15 through respective second transmission lines 1511, 1521, and have electrical connection points 151, 152. The second transmission lines 1511 and 1521 could be signal control lines, electric wires, conductor wires, conductor lines or enamelled wires. The second circuit 15 could be an algorithm processing circuit, a switching control circuit, a microcontroller, a switch control module, or a signal processing integrated circuit chip.

In order to successfully achieve the technical effects of miniaturization, high integration, diversified radiation pattern variations, and multi-stream high-data-rate communication, in the highly integrated pattern-variable multi-antenna array 1 of an embodiment of the disclosure, by designing the first inverted L-shaped resonant structure 112 to have the first switch 1123 and to be electrically connected to the ground conductor structure 10, and designing the second inverted L-shaped resonant structure 122 to have the second switch 1223 and to be electrically connected to the ground conductor structure 10, and changing the first switch 1123 and the second switch 1223 between different turn-on and turn-off state combinations, the effect of controlling the radiation pattern variations of the first antenna array 11 and the second antenna array 12 could be successfully achieved. By designing the array conjoined grounding structure 13 to have the array conjoined capacitive structure 133, and to electrically connect the first inverted L-shaped resonant structure 111, the second inverted L-shaped resonant structure 121, and the ground conductor structure 10, an overall size of the first antenna array 11 and the second antenna array 12 could be successfully reduced, and a mutual coupling effect between the first antenna array 11 and the second antenna array 12 could be successfully reduced, and the mutual interference of the first switch 1123 and the second switch 1223 under different turn-on and turn-off state combinations could be reduced, so as to successfully achieve the effect of generating diversified radiation patterns. In the highly integrated pattern-variable multi-antenna array 1, by designing the first distance d11224 between the first feeding point 1112 and the adjacent first switch center point 1124, where the first distance d11224 is between 0.05 wavelength and 0.6 wavelength of the lowest operating frequency of the first communication frequency band, and designing the third distance d21224 between the second feeding point 1212 and the adjacent second switch center point 1224, where the third distance d21224 is between 0.05 wavelength and 0.6 wavelength of the lowest operating frequency of the first communication frequency band, correlation of the radiation patterns between the first antenna array 11 and the second antenna array 12 would be reduced, so as to successfully reduce the mutual interference between multiple data streams. In the highly integrated pattern-variable multi-antenna array 1, by designing the length of each of the first resonance paths 1111 and 1121 to be between 0.1 wavelength and 0.5 wavelength of the lowest operating frequency of the first communication frequency band, and designing the length of each of the second resonance paths 1211 and 1221 to be between 0.1 wavelength and 0.5 wavelength of the lowest operating frequency of the first communication frequency band, the effect that the first resonance mode generated by the first antenna array 11 and the second resonance mode generated by the second antenna array 12 have good impedance matching would be achieved, and meanwhile the diversity of radiation pattern directivities of the first antenna array 11 and the second antenna array 12 in the first communication frequency band would be increased. Therefore, the highly integrated pattern-variable multi-antenna array 1 of the embodiment of the disclosure could successfully achieve the technical effects of miniaturization, high integration, diversified radiation pattern variations, and multi-stream high-data-rate communication. A single set or multiple sets of the highly integrated pattern-variable multi-antenna array 1 of the disclosure could be implemented in a communication device, where the first antenna array 11 and the second antenna array 12 could be arranged on the same side of the ground conductor structure 10, the first antenna array 11 and the second antenna array 12 could also be arranged on adjacent different sides of the ground conductor structure 10. In addition, the communication device may be a mobile communication device, a wireless communication device, a mobile computing device, a computer system, telecommunications equipment, base station equipment, network equipment, or peripheral equipment of a computer or a network, etc.

Figure 2:
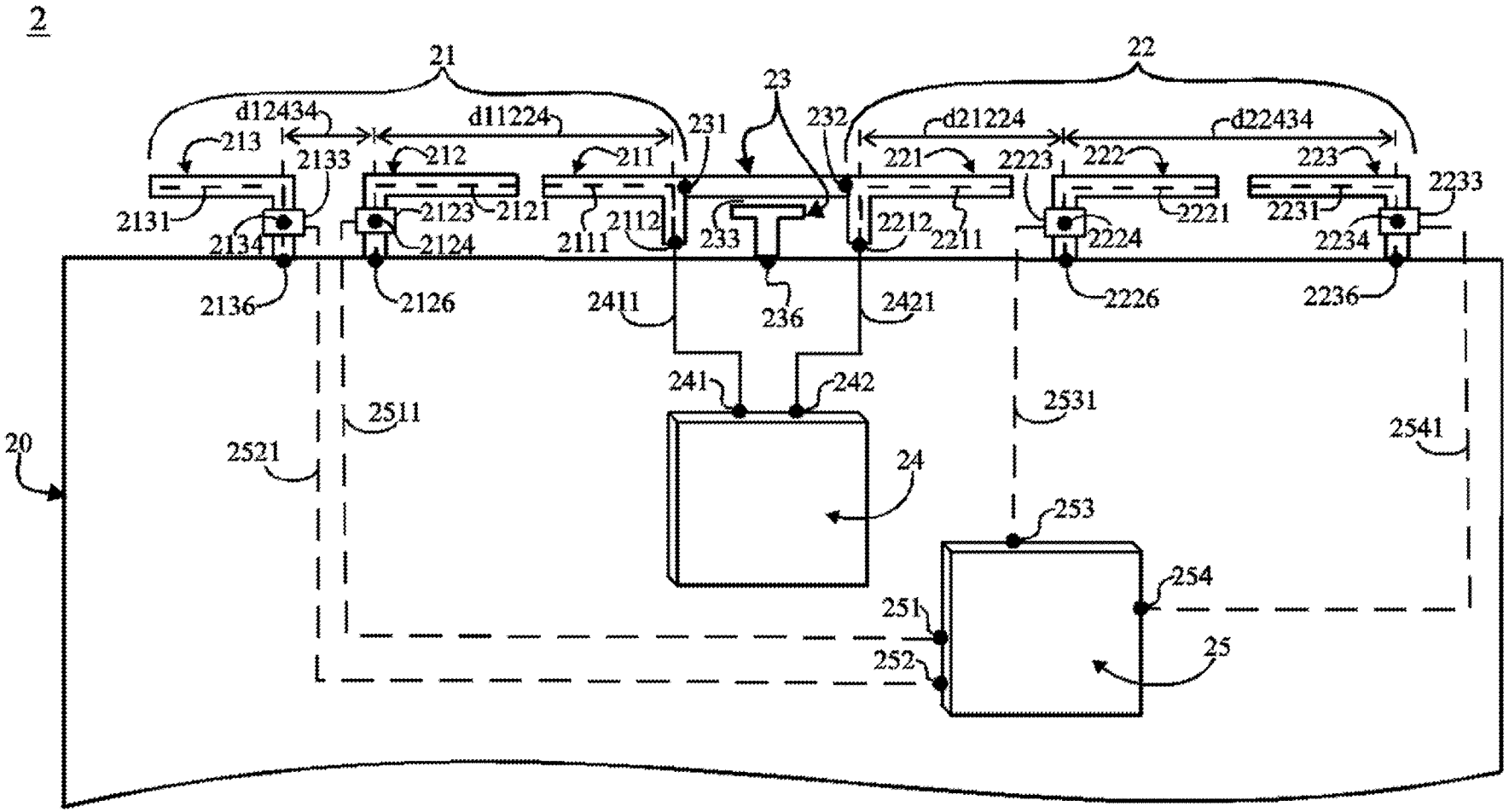
FIG. 2 is a structural diagram of a highly integrated pattern-variable multi-antenna array 2 according to an embodiment of the disclosure.

FIG. 2 is a structural diagram of a highly integrated pattern-variable multi-antenna array 2 according to an embodiment of the disclosure. As shown in FIG. 2, a highly integrated pattern-variable multi-antenna array 2 includes a ground conductor structure 20, a first antenna array 21, a second antenna array 22 and an array conjoined grounding structure 23. The first antenna array 21 includes a plurality of first inverted L-shaped resonant structures 211, 212, and 213. The first inverted L-shaped resonant structures 211, 212, and 213 respectively have first resonance paths 2111, 2121, 2131. The first inverted L-shaped resonant structure 211 has a first feeding point 2112, and the other first inverted L-shaped resonant structures 212 and 213 respectively have first switches 2123, 2133, and are electrically connected or coupled to the ground conductor structure 20, and have electrical connection points 2126 and 2136. The first switches 2123, 2133 respectively have first switch center points 2124, 2134. The first antenna array 21 generates a first resonance mode. The second antenna array 22 includes a plurality of second inverted L-shaped resonant structures 221, 222, and 223. The second inverted L-shaped resonant structures 221, 222, and 223 respectively have second resonance paths 2211, 2221, 2231. The second inverted L-shaped resonant structure 221 has a second feeding point 2212, and the other second inverted L-shaped resonant structures 222 and 223 respectively have second switches 2223, 2233, and are electrically connected or coupled to the ground conductor structure 20, and have electrical connection points 2226 and 2236. The second switches 2223, 2233 respectively have second switch center points 2224, 2234. The second antenna array 22 generates a second resonance mode. The second resonance mode and the first resonance mode cover at least one same first communication frequency band. The array conjoined grounding structure 23 has an array conjoined capacitive structure 233, and is electrically connected to the adjacent first inverted L-shaped resonant structure 211, the second inverted L-shaped resonant structure 221, and the ground conductor structure 20, the first inverted L-shaped resonant structure 211 has the first feeding point 2112, and the second inverted L-shaped resonant structure 221 has the second feeding point 2212. The array conjoined grounding structure 23 has electrical connection points 231, 232 and 236. The array conjoined capacitive structure 233 is a slit coupling capacitor structure, and the gap of the slit coupling capacitor structure is less than or equal to 0.02 wavelength of the lowest operating frequency of the first communication frequency band. The first inverted L-shaped resonant structures 211, 212, 213 or the second inverted L-shaped resonant structures 221, 222, 223 could also have partial turning or meandering sections to adjust an impedance matching level of the first resonance mode and the second resonance mode.

There is a first distance d11224 between the first feeding point 2112 and the adjacent first switch center point 2124, and the first distance d11224 is between 0.05 wavelength and 0.6 wavelength of the lowest operating frequency of the first communication frequency band. There is a second distance d12434 between the adjacent first switch center points 2124, 2134, and the second distance d12434 is between 0.05 wavelength and 0.5 wavelength of the lowest operating frequency of the first communication frequency band. There is a third distance d21224 between the second feeding point 2212 and the adjacent second switch center point 2224, and the third distance d21224 is between 0.05 wavelength and 0.6 wavelength of the lowest operating frequency of the first communication frequency band. There is a fourth distance d22434 between the adjacent second switch center points 2224, 2234, and the fourth distance d22434 is between 0.05 wavelength and 0.5 wavelength of the lowest operating frequency of the first communication frequency band. The length of each of the first resonance paths 2111, 2121 and 2123 is between 0.1 wavelength and 0.5 wavelength of the lowest operating frequency of the first communication frequency band. The length of each of the second resonance paths 2211, 2221 and 2231 is between 0.1 wavelength and 0.5 wavelength of the lowest operating frequency of the first communication frequency band. The first switches 2123, 2133 and the second switches 2223 and 2233 could be respectively a diode switch, a mechanical switch, a semiconductor switch, a radio frequency switch, a microelectromechanical switch or a chip switch. The first feeding point 2112 and the second feeding point 2212 are electrically connected or coupled to a first circuit 24 through respective first transmission lines 2411, 2421, and have electrical connection points 241, 242. The first transmission lines 2411, 2421 could be respectively a radio frequency transmission line, a coaxial transmission line, a microstrip transmission line, a flat-plate transmission line or a strip line. The first circuit 24 may be a power combining circuit, a phase control circuit, a frequency up/down-conversion circuit, an impedance matching circuit, an amplifier module, an integrated circuit chip, a radio frequency module or a multi-input multi-output transceiver module. The first switches 2123, 2133 and the second switches 2223, 2233 are electrically connected or coupled to a second circuit 25 through respective second transmission lines 2511, 2521, 2531, 2541, and have electrical connection points 251, 252, 253 and 254. The second transmission lines 2511, 2521, 2531 and 2541 may be signal control lines, electric wires, conductor wires, conductor lines or enamelled wires. The second circuit 25 may be an algorithm processing circuit, a switching control circuit, a microcontroller, a switch control module, or a signal processing integrated circuit chip.

In the highly integrated pattern-variable multi-antenna array 2 of FIG. 2, an arrangement direction of the first inverted L-shaped resonant structure 212 is different from an arrangement direction of the first inverted L-shaped resonant structure 112 of the highly integrated pattern-variable multi-antenna array 1. In addition, the highly integrated pattern-variable multi-antenna array 2 is additionally configured with the first inverted L-shaped resonant structure 213 and the first switch 2133, and is additionally configured with the second inverted L-shaped resonant structure 223 and the first switch 2233. Moreover, the array conjoined capacitive structure 233 of the highly integrated pattern-variable multi-antenna array 2 is a slit coupling capacitor structure, which is also different to the array conjoined capacitive structure 133 of the highly integrated pattern-variable multi-antenna array 1. However, in the highly integrated pattern-variable multi-antenna array 2, by designing the first inverted L-shaped resonant structures 212 and 213 to respectively have the first switches 2123, 2133 and to be electrically connected to the ground conductor structure 20, and designing the second inverted L-shaped resonant structures 222 and 223 to respectively have the second switches 2223, 2233 and to be electrically connected to the ground conductor structure 20, and changing each of the first switches 2123, 2133 and each of the second switches 2223, 2233 between different turn-on and turn-off state combinations, the effect of controlling the radiation pattern variations of the first antenna array 21 and the second antenna array 22 could also be successfully achieved. By designing the array conjoined grounding structure 23 to have the array conjoined capacitive structure 233, and to electrically connect the adjacent first inverted L-shaped resonant structure 211, the second inverted L-shaped resonant structure 221, and the ground conductor structure 20, an overall size of the first antenna array 21 and the second antenna array 22 could also be successfully reduced, and a mutual coupling effect between the first antenna array 21 and the second antenna array 22 is successfully reduced, and the mutual interference of each of the first switches 2123, 2133 and each of the second switches 2223, 2233 under different turn-on and turn-off state combinations would be reduced, so as to successfully achieve the effect of generating diversified radiation patterns. In the highly integrated pattern-variable multi-antenna array 2, by designing the first distance d11224 between the first feeding point 2112 and the adjacent first switch center point 2124, where the first distance d11224 is between 0.05 wavelength and 0.6 wavelength of the lowest operating frequency of the first communication frequency band, designing the second distance d12434 between the adjacent first switch center points 2124, 2134, where the second distance d12434 is between 0.05 wavelength and 0.5 wavelength of the lowest operating frequency of the first communication frequency band, designing the third distance d21224 between the second feeding point 2212 and the adjacent second switch center point 2224, where the third distance d21224 is between 0.05 wavelength and 0.6 wavelength of the lowest operating frequency of the first communication frequency band, and designing the fourth distance d22434 between the adjacent second switch center points 2224, 2234, where the fourth distance d22434 is between 0.05 wavelength and 0.5 wavelength of the lowest operating frequency of the first communication frequency band, correlation of the radiation patterns between the first antenna array 21 and the second antenna array 22 could be reduced, so as to successfully reduce the mutual interference between multiple data streams. In the highly integrated pattern-variable multi-antenna array 2, by designing the length of each of the first resonance paths 2111, 2121, 2131 to be between 0.1 wavelength and 0.5 wavelength of the lowest operating frequency of the first communication frequency band, and designing the length of each of the second resonance paths 2211, 2221, 2231 to be between 0.1 wavelength and 0.5 wavelength of the lowest operating frequency of the first communication frequency band, the effect that the first resonance mode generated by the first antenna array 21 and the second resonance mode generated by the second antenna array 22 have good impedance matching could be achieved, and meanwhile the diversity of radiation pattern directivities of the first antenna array 21 and the second antenna array 22 in the first communication frequency band would be increased. Therefore, the highly integrated pattern-variable multi-antenna array 2 of the embodiment of the disclosure could also successfully achieve the technical effects of miniaturization, high integration, diversified radiation pattern variations, and multi-stream high-data-rate communication. A single set or multiple sets of the highly integrated pattern-variable multi-antenna array 2 of the disclosure may be implemented in the communication device, where the first antenna array 21 and the second antenna array 22 may be arranged on the same side of the ground conductor structure 20, the first antenna array 21 and the second antenna array 22 may also be arranged on adjacent different sides of the ground conductor structure 20. In addition, the communication device may be a mobile communication device, a wireless communication device, a mobile computing device, a computer system, telecommunications equipment, base station equipment, network equipment, or peripheral equipment of a computer or a network, etc.

Figure 3A:
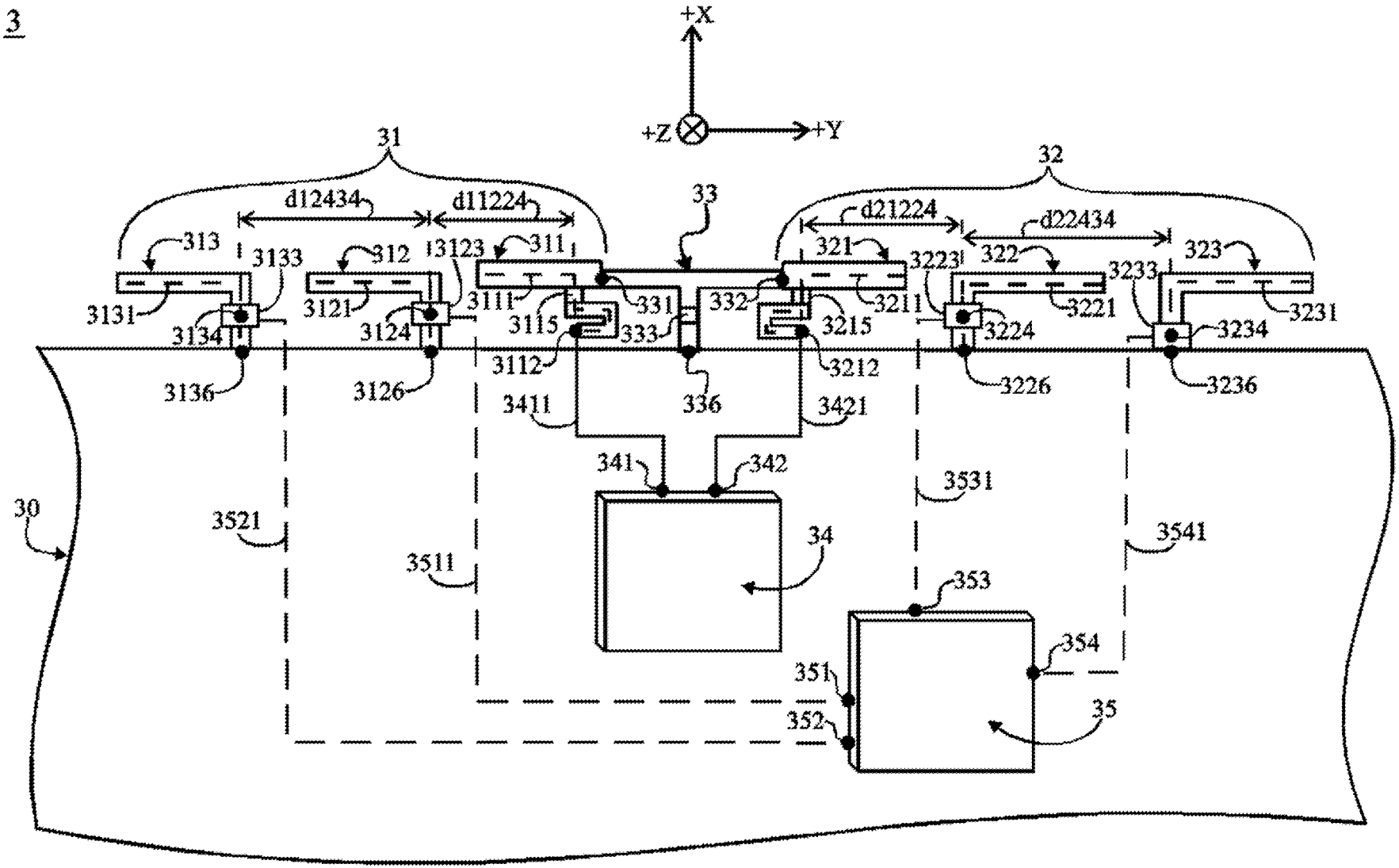
FIG. 3A is a structural diagram of a highly integrated pattern-variable multi-antenna array 3 according to an embodiment of the disclosure.
Figure 3B:
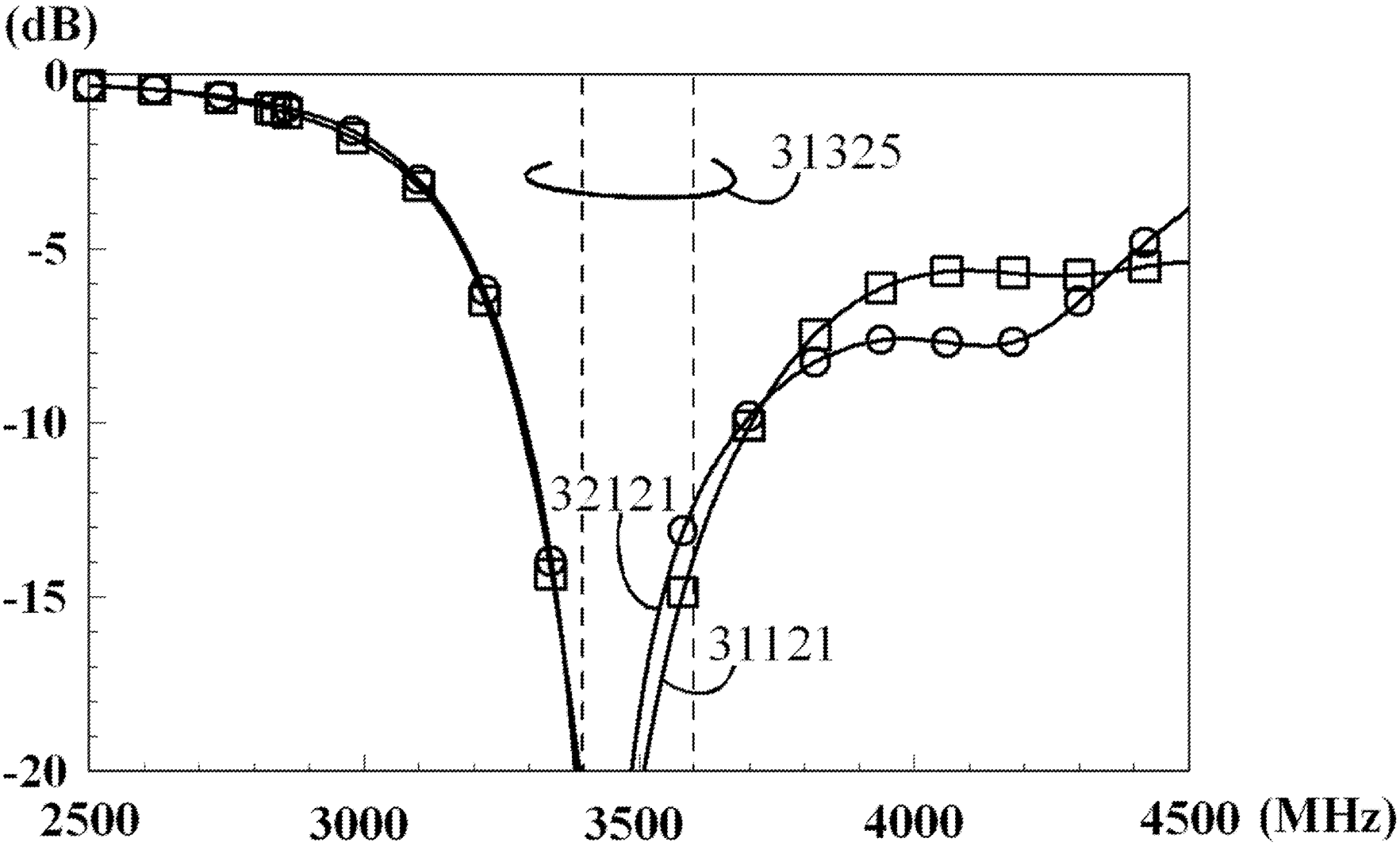
FIG. 3B is a return loss curve diagram of the highly integrated field variable multi-antenna array 3 according to an embodiment of the disclosure.
Figure 3C:
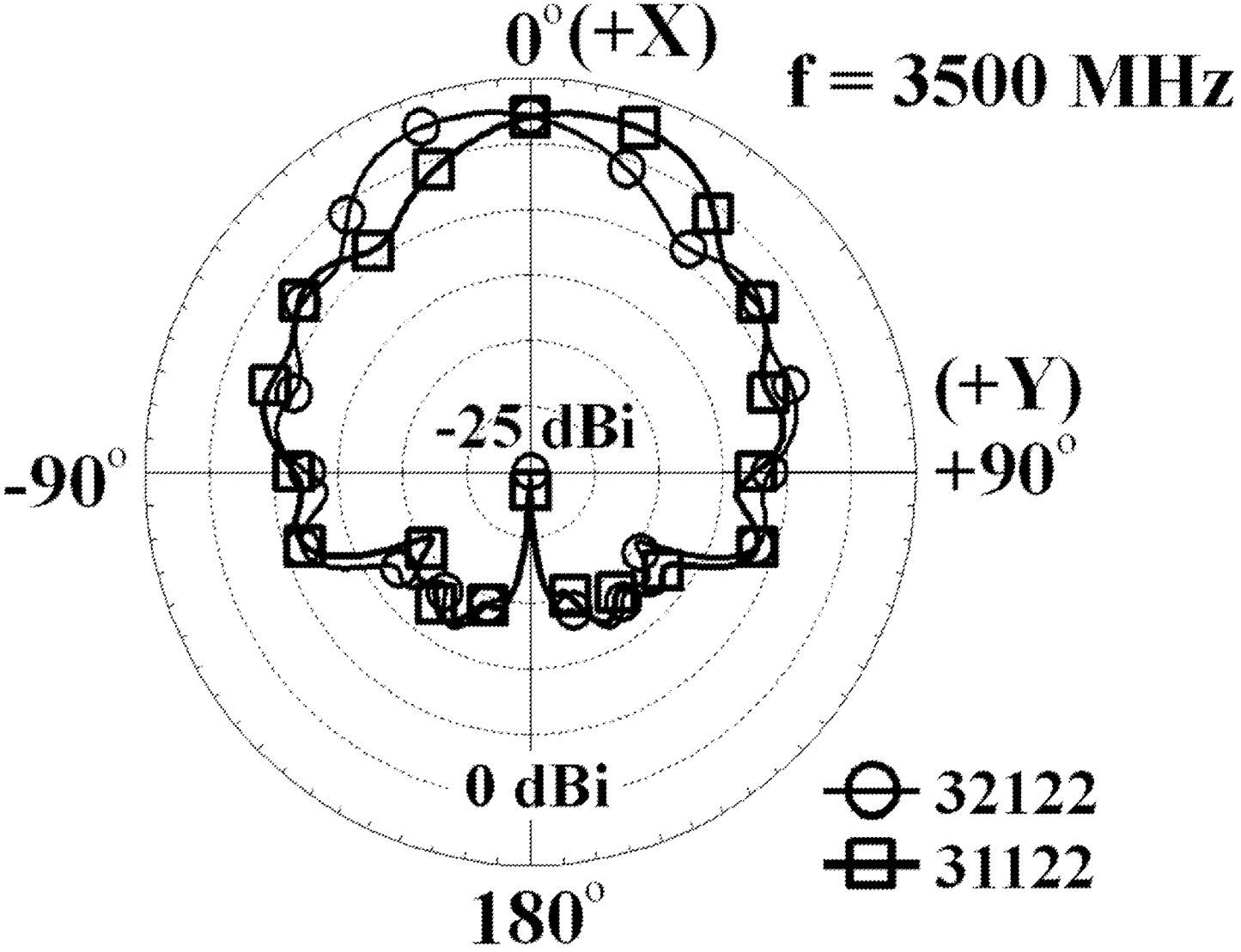
Figure 3D:
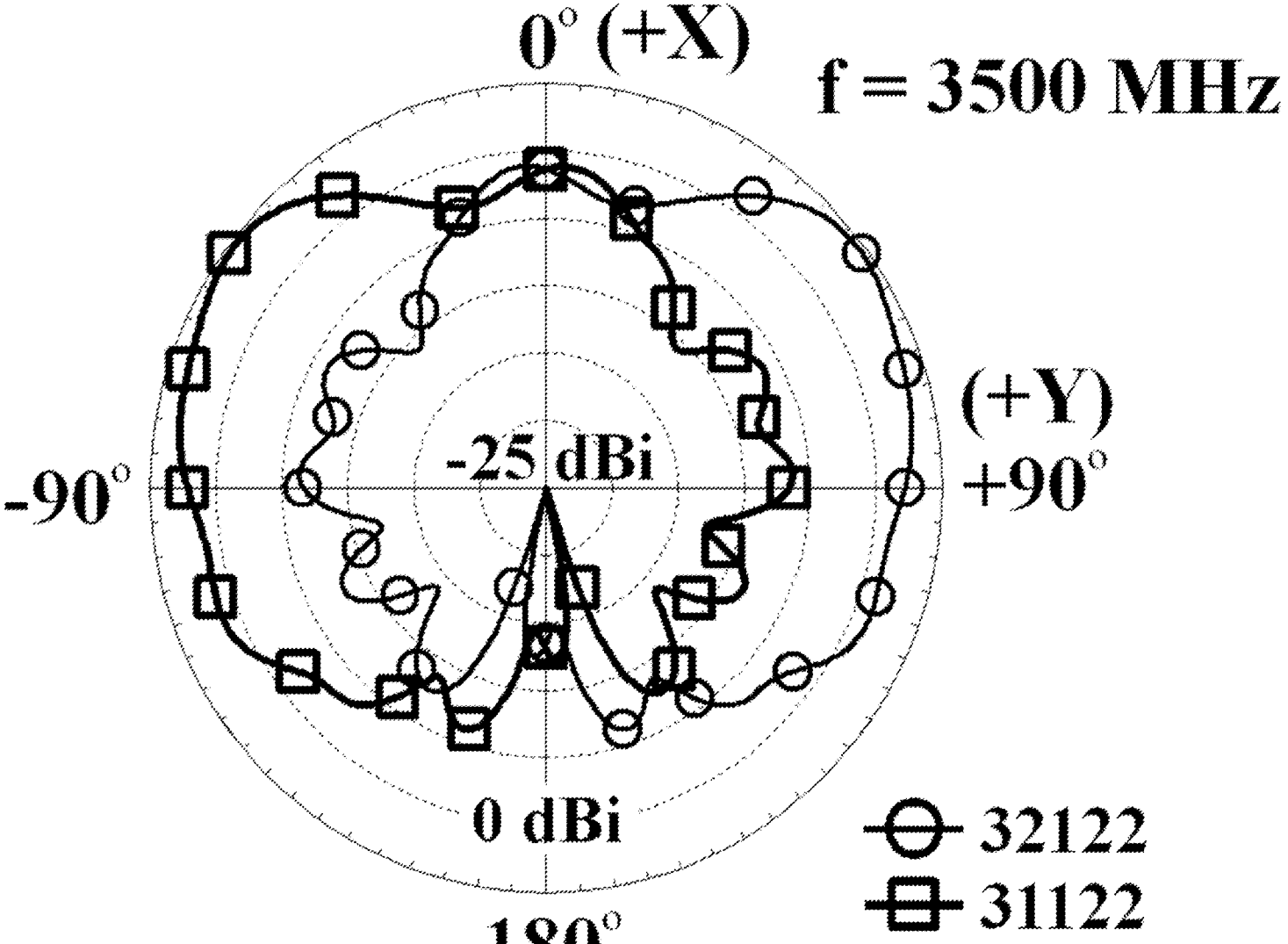
FIG. 3D is a 2D radiation pattern curve diagram of the highly integrated pattern-variable multi-antenna array 3 under a condition that the first switch 3123 is turned off, the first switch 3133 is turned off, the second switch 3223 is turned off and the second switch 3233 is turned off.
Figure 3E:
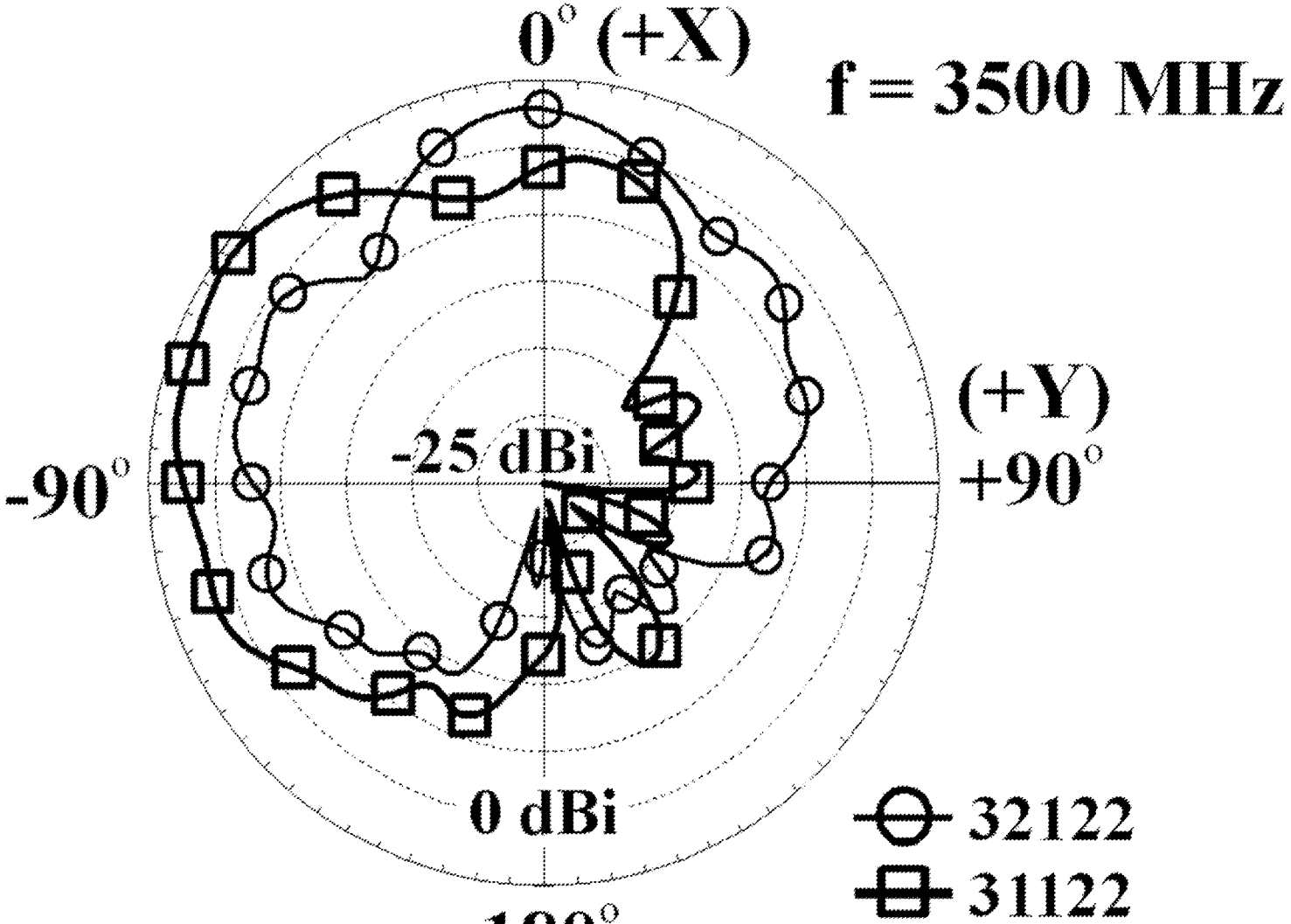
Figure 3F:
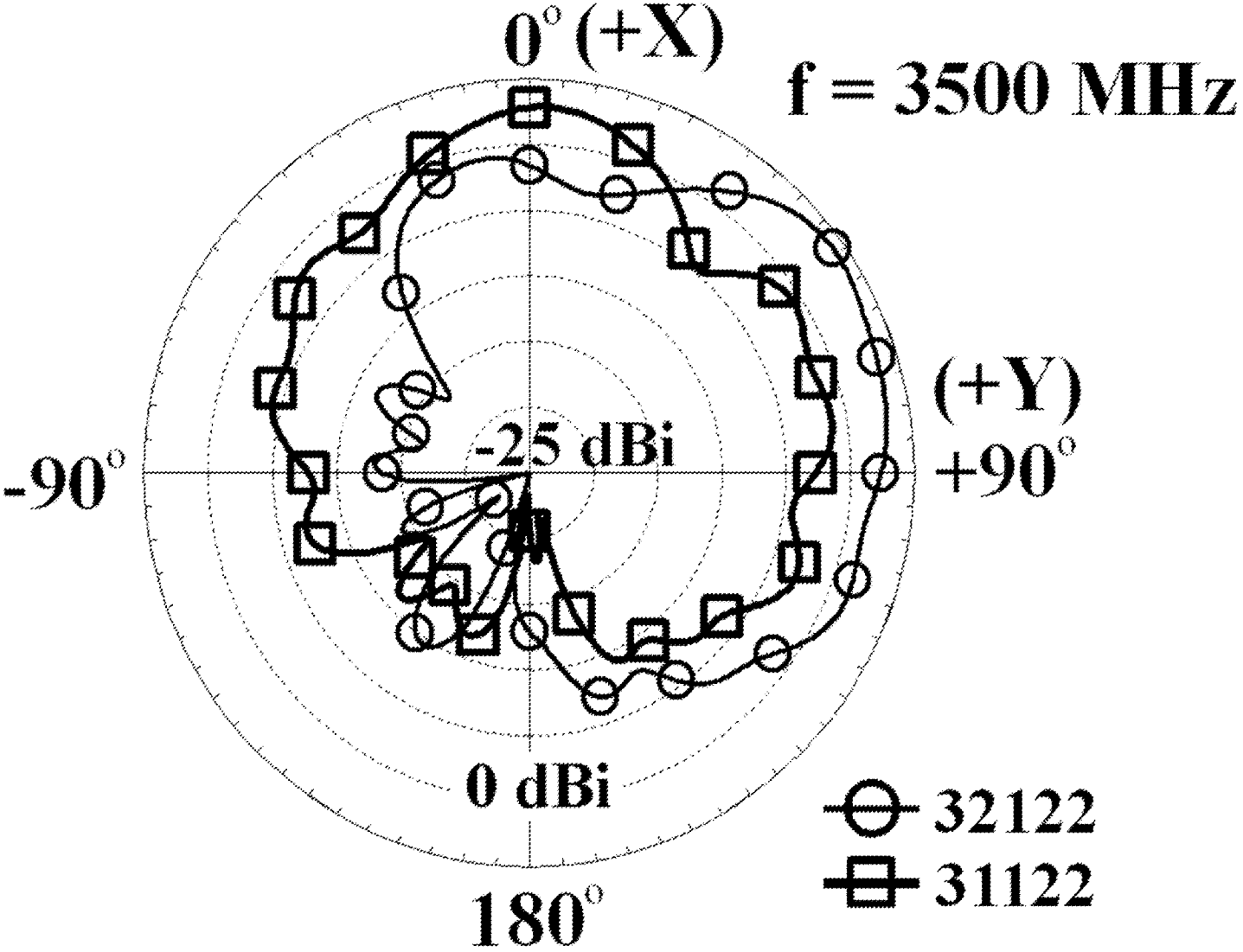
FIG. 3F is a 2D radiation pattern curve diagram of the highly integrated pattern-variable multi-antenna array 3 under a condition that the first switch 3123 is turned on, the first switch 3133 is turned on, the second switch 3223 is turned off and the second switch 3233 is turned off.
Figure 3G:
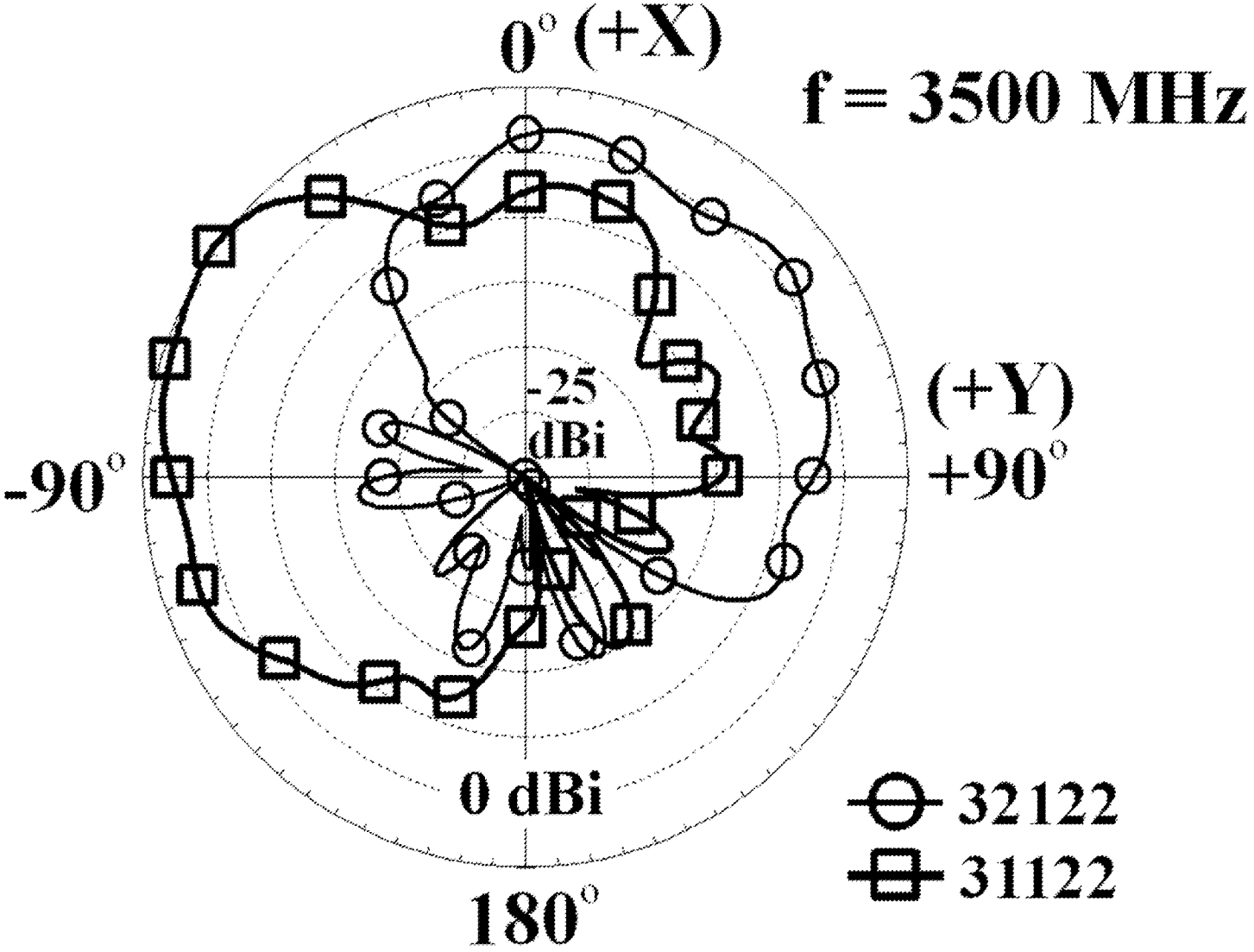
Figure 3H:
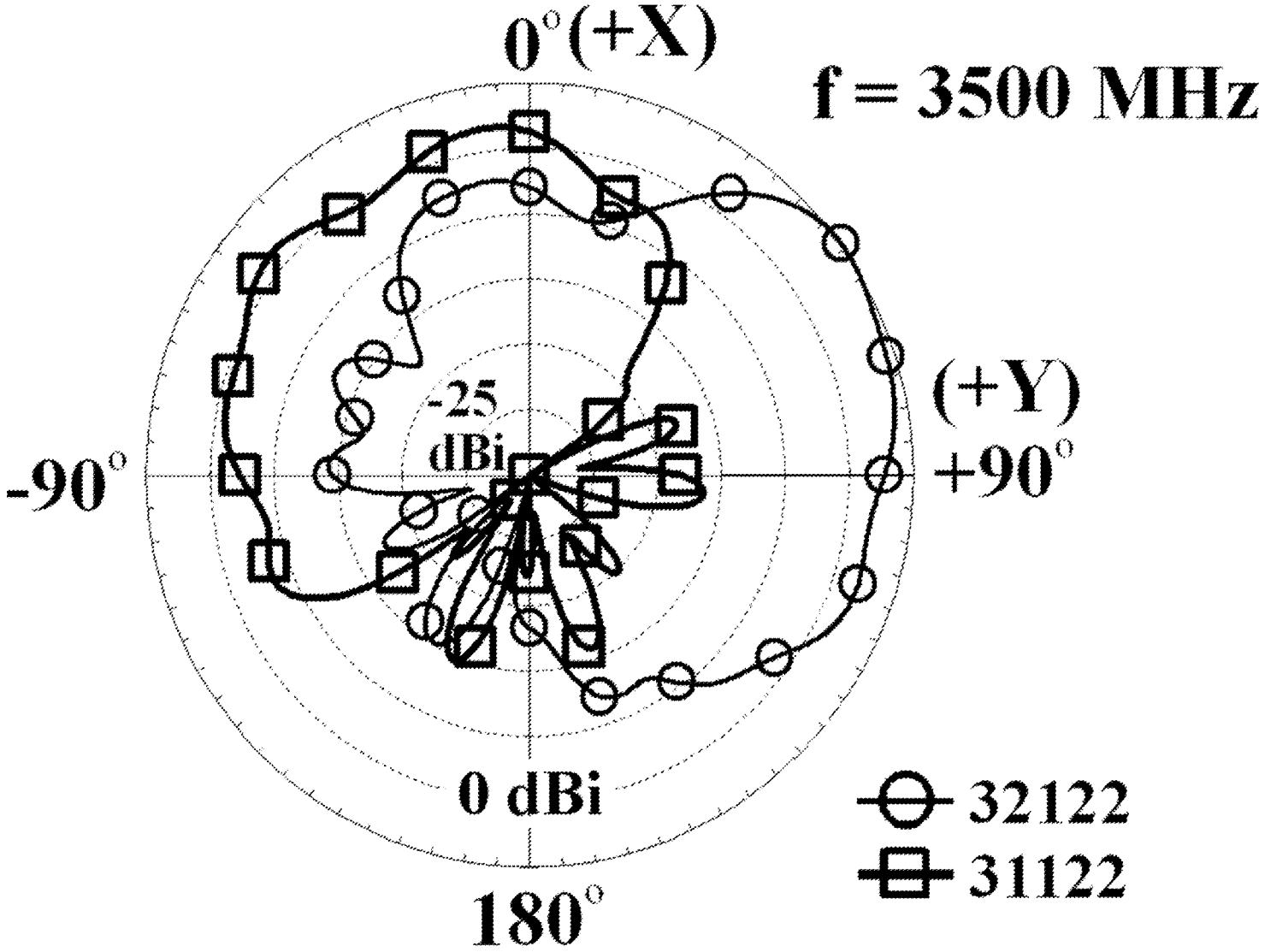
FIG. 3H is a 2D radiation pattern curve diagram of the highly integrated pattern-variable multi-antenna array 3 under a condition that the first switch 3123 is turned off, the first switch 3133 is turned on, the second switch 3223 is turned off and the second switch 3233 is turned off.
Figure 3I:
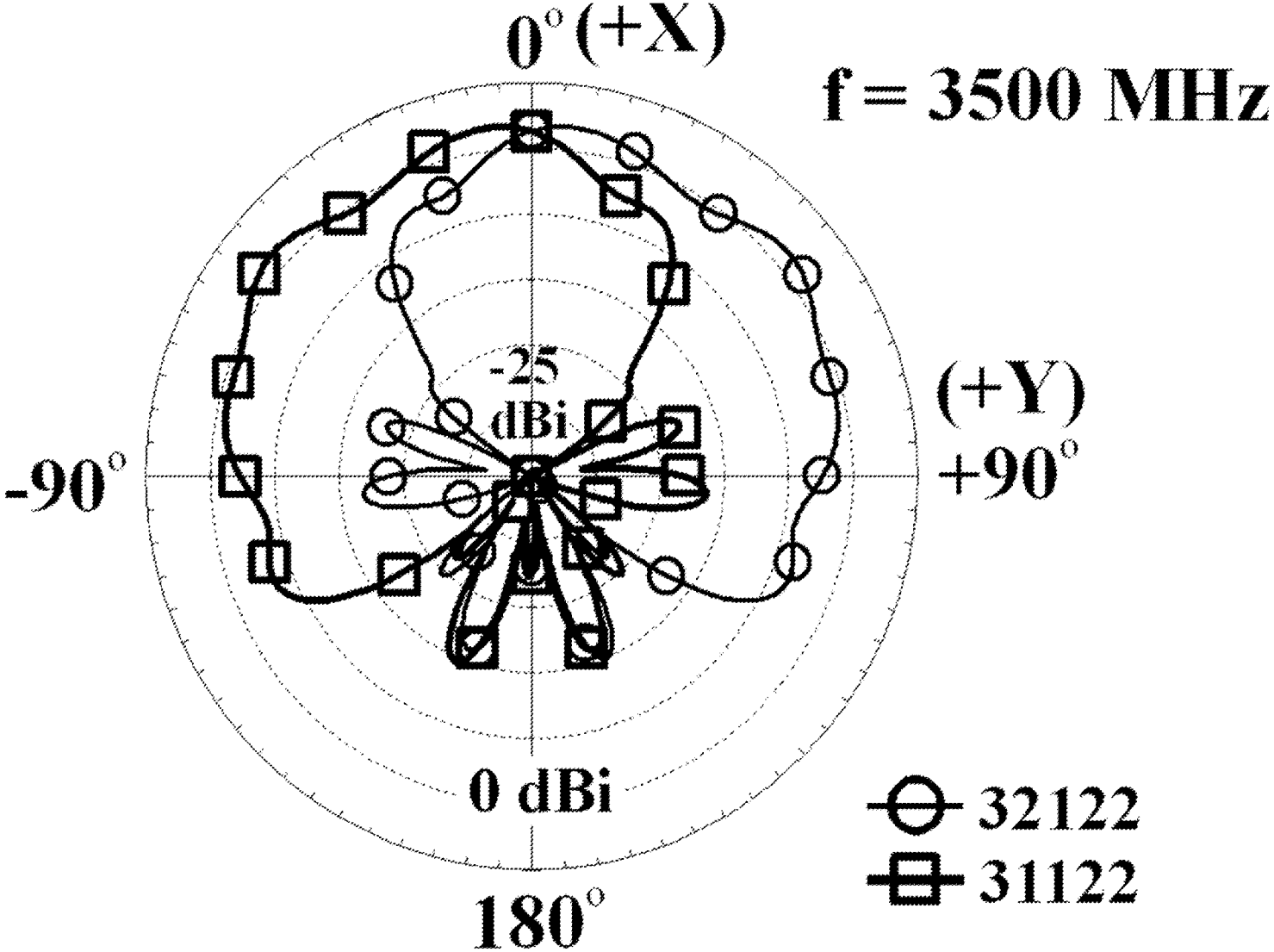

FIG. 3A is a structural diagram of a highly integrated pattern-variable multi-antenna array 3 according to an embodiment of the disclosure. FIG. 3B is a return loss curve diagram of the highly integrated field variable multi-antenna array 3 according to an embodiment of the disclosure. FIG. 3C, FIG. 3D, FIG. 3E, FIG. 3F, FIG. 3G, FIG. 3H, FIG. 3I are respectively 2D radiation pattern curve diagrams of the highly integrated pattern-variable multi-antenna array 3 under different turn-on and turn-off conditions of each of first switches 3123, 3133 and each of second switches 3223, 3233 according to an embodiment of the disclosure. As shown in FIG. 3A and FIG. 3B, the highly integrated pattern-variable multi-antenna array 3 includes a ground conductor structure 30, a first antenna array 31, a second antenna array 32 and an array conjoined grounding structure 33. The first antenna array 31 includes a plurality of first inverted L-shaped resonant structures 311, 312, and 313. The first inverted L-shaped resonant structures 311, 312, and 313 respectively have first resonance paths 3111, 3121, 3131. The first inverted L-shaped resonant structure 311 has a first feeding point 3112, and the other first inverted L-shaped resonant structures 312 and 313 respectively have first switches 3123, 3133, and are electrically connected or coupled to the ground conductor structure 30, and have electrical connection points 3126 and 3136. A short side of the first inverted L-shaped resonant structure 311 has a partial meandering resonance path, where the first inverted L-shaped resonant structure 311 has a first capacitor structure 3115, and the first capacitor structure 3115 is a lumped capacitor element or a chip capacitor element. The first switches 3123, 3133 respectively have first switch center points 3124, 3134. The first antenna array 31 generates a first resonance mode 31121 (shown in FIG. 3B). The second antenna array 32 includes a plurality of second inverted L-shaped resonant structures 321, 322, and 323. The second inverted L-shaped resonant structures 321, 322, and 323 respectively have second resonance paths 3211, 3221, 3231. The second inverted L-shaped resonant structure 321 has a second feeding point 3212, and the other second inverted L-shaped resonant structures 322 and 323 respectively have second switches 3223, 3233, and are electrically connected or coupled to the ground conductor structure 30, and have electrical connection points 3226 and 3236. A short side of the second inverted L-shaped resonant structure 321 has a partial meandering resonance path, where the second inverted L-shaped resonant structure 321 has a second capacitor structure 3215, and the second capacitor structure 3215 is a lumped capacitor element or a chip capacitor element. The second switches 3223, 3233 respectively have second switch center points 3224, 3234. The second antenna array 32 generates a second resonance mode 32121 (shown in FIG. 3B). The second resonance mode 32121 and the first resonance mode 31121 cover at least one identical first communication frequency band 31325. The array conjoined grounding structure 33 has an array conjoined capacitive structure 333, and is electrically connected to the adjacent first inverted L-shaped resonant structure 311, the second inverted L-shaped resonant structure 321, and the ground conductor structure 30, the first inverted L-shaped resonant structure 311 has the first feeding point 3112, and the second inverted L-shaped resonant structure 321 has the second feeding point 3212. The array conjoined grounding structure 33 has electrical connection points 331, 332 and 336. The array conjoined capacitive structure 333 is a lumped capacitor element or a chip capacitor element. The first inverted L-shaped resonant structures 311, 312, 313 or the second inverted L-shaped resonant structures 321, 322, 323 could also have partial turning or meandering sections to adjust an impedance matching level of the first resonance mode 31121 and the second resonance mode 32121.

There is a first distance d11224 between the first feeding point 3112 and the adjacent first switch center point 3124, and the first distance d11224 is between 0.05 wavelength and 0.6 wavelength of the lowest operating frequency of the first communication frequency band 31325. There is a second distance d12434 between the adjacent first switch center points 3124, 3134, and the second distance d12434 is between 0.05 wavelength and 0.5 wavelength of the lowest operating frequency of the first communication frequency band 31325. There is a third distance d21224 between the second feeding point 3212 and the adjacent second switch center point 3224, and the third distance d21224 is between 0.05 wavelength and 0.6 wavelength of the lowest operating frequency of the first communication frequency band 31325. There is a fourth distance d22434 between the adjacent second switch center points 3224, 3234, and the fourth distance d22434 is between 0.05 wavelength and 0.5 wavelength of the lowest operating frequency of the first communication frequency band 31325. The length of each of the first resonance paths 3111, 3121 and 3131 is between 0.1 wavelength and 0.5 wavelength of the lowest operating frequency of the first communication frequency band 31325. The length of each of the second resonance paths 3211, 3221 and 3231 is between 0.1 wavelength and 0.5 wavelength of the lowest operating frequency of the first communication frequency band 31325. The first switches 3123, 3133 and the second switches 3223 and 3233 could be respectively a diode switch, a mechanical switch, a semiconductor switch, a radio frequency switch, a microelectromechanical switch or a chip switch. The first feeding point 3112 and the second feeding point 3212 are electrically connected or coupled to a first circuit 34 through respective first transmission lines 3411, 3421, and have electrical connection points 341, 342. The first transmission lines 3411, 3421 could be respectively a radio frequency transmission line, a coaxial transmission line, a microstrip transmission line, a flat-plate transmission line or a strip line. The first circuit 34 excites the first antenna array 31 to generate the first resonance mode 31121 and excites the second antenna array 32 to generate the second resonance mode 32121 (as shown in FIG. 3B). The first circuit 34 could be a power combining circuit, a phase control circuit, a frequency up/down-conversion circuit, an impedance matching circuit, an amplifier module, an integrated circuit chip, a radio frequency module or a multi-input multi-output transceiver module. The first switches 3123, 3133 and the second switches 3223, 3233 are electrically connected or coupled to a second circuit 35 through respective second transmission lines 3511, 3521, 3531, 3541, and have electrical connection points 351, 352, 353 and 354. The second transmission lines 3511, 3521, 3531 and 3541 could be signal control lines, electric wires, conductor wires, conductor lines or enamelled wires. The second circuit 35 could control each of the first switches 3123 and 3133 and each of the second switches 3223 and 3233 to be in a turn-on or turn-off condition. The second circuit 35 could be an algorithm processing circuit, a switching control circuit, a microcontroller, a switch control module, or a signal processing integrated circuit chip.

In the highly integrated pattern-variable multi-antenna array 3 of an embodiment of the disclosure shown in FIG. 3A, arrangement directions and shapes of the first inverted L-shaped resonant structures 311, 312, 313 and the second inverted L-shaped resonant structures 321, 322, 323 are not completely the same to the arrangement directions and shapes of the first inverted L-shaped resonant structures 211, 212, 213 and the second inverted L-shaped resonant structures 221, 222, 223 of the highly integrated pattern-variable multi-antenna array 2. In addition, in the highly integrated pattern-variable multi-antenna array 3, the first inverted L-shaped resonant structure 311 is configured with the first capacitor structure 3115, and the second inverted L-shaped resonant structure 321 is configured with the second capacitor structure 3215. Moreover, the array conjoined capacitive structure 333 of the highly integrated pattern-variable multi-antenna array 3 is a lumped capacitive element or a chip capacitor element, which is also different to the array conjoined capacitive structure 233 of the highly integrated pattern-variable multi-antenna array 2. However, in the highly integrated pattern-variable multi-antenna array 3, by designing the first inverted L-shaped resonant structures 312 and 313 to respectively have the first switches 3123, 3133 and to be electrically connected to the ground conductor structure 30, and designing the second inverted L-shaped resonant structures 322 and 323 to respectively have the second switches 3223, 3233 and to be electrically connected to the ground conductor structure 30, and changing each of the first switches 3123, 3133 and each of the second switches 3223, 3233 between different turn-on and turn-off state combinations, the effect of controlling the radiation pattern variations of the first antenna array 31 and the second antenna array 32 could also be successfully achieved. By designing the array conjoined grounding structure 33 to have the array conjoined capacitive structure 333, and to electrically connect the adjacent first inverted L-shaped resonant structure 311, the second inverted L-shaped resonant structure 321, and the ground conductor structure 30, an overall size of the first antenna array 31 and the second antenna array 32 could also be successfully reduced, and a mutual coupling effect between the first antenna array 31 and the second antenna array 32 would be successfully reduced, and the mutual interference of each of the first switches 3123, 3133 and each of the second switches 3223, 3233 under different turn-on and turn-off state combinations is reduced, so as to successfully achieve the effect of generating diversified radiation patterns. In the highly integrated pattern-variable multi-antenna array 3, by designing the first distance d11224 between the first feeding point 3112 and the adjacent first switch center point 3124, where the first distance d11224 is between 0.05 wavelength and 0.6 wavelength of the lowest operating frequency of the first communication frequency band 31325, designing the second distance d12434 between the adjacent first switch center points 3124, 3134, where the second distance d12434 is between 0.05 wavelength and 0.5 wavelength of the lowest operating frequency of the first communication frequency band 31325, designing the third distance d21224 between the second feeding point 3212 and the adjacent second switch center point 3224, where the third distance d21224 is between 0.05 wavelength and 0.6 wavelength of the lowest operating frequency of the first communication frequency band 31325, and designing the fourth distance d22434 between the adjacent second switch center points 3224, 3234, where the fourth distance d22434 is between 0.05 wavelength and 0.5 wavelength of the lowest operating frequency of the first communication frequency band 31325, correlation of the radiation patterns between the first antenna array 31 and the second antenna array 32 is reduced, so as to successfully reduce the mutual interference between multiple data streams. In the highly integrated pattern-variable multi-antenna array 3, by designing the length of each of the first resonance paths 3111, 3121, 3131 to be between 0.1 wavelength and 0.5 wavelength of the lowest operating frequency of the first communication frequency band 31325, and designing the length of each of the second resonance paths 3211, 3221, 3231 to be between 0.1 wavelength and 0.5 wavelength of the lowest operating frequency of the first communication frequency band 31325, the effect that the first resonance mode 31121 generated by the first antenna array 31 and the second resonance mode 32121 generated by the second antenna array 32 have good impedance matching could be achieved, and meanwhile the diversity of radiation pattern directivities of the first antenna array 31 and the second antenna array 32 in the first communication frequency band 31325 would be increased. Therefore, the highly integrated pattern-variable multi-antenna array 3 of the embodiment of the disclosure could successfully achieve the technical effects of miniaturization, high integration, diversified radiation pattern variations, and multi-stream high-data-rate communication.

FIG. 3B is a return loss curve diagram of the highly integrated field variable multi-antenna array 3 according to an embodiment of the disclosure. Following sizes are selected for experiment: a length of the ground conductor structure is about 200 mm, and a width thereof is about 150 mm; lengths of the first resonance paths 3111, 3121, and 3131 are respectively about 17.25 mm, 16.75 mm and 16.75 mm; the first distance d11224 is about 15.44 mm; the second distance d12434 is about 15 mm; lengths of the second resonance paths 3211, 3221, and 3231 are respectively about 17.25 mm, 16.75 mm and 16.75 mm; the third distance d21224 is about 15.44 mm; the fourth distance d22434 is about 15 mm; a capacitance value of the array conjoined capacitive structure 333 is about 1.2 pF. As shown in FIG. 3B, the first antenna array 31 could successfully generate the first resonance mode 31121, the second antenna array 32 could successfully generate the second resonance mode 32121, and the first resonance mode 31121 and the second resonance mode 32121 cover the same first communication frequency band 31325 (3400 MHz-3600 MHz), and the lowest operating frequency of the first communication frequency band 31325 is 3400 MHz. The first resonance mode 31121 and the second resonance mode 32121 both achieve a good impedance matching in the first communication frequency band 31325. Therefore, it is verified that the first antenna array 31 and the second antenna array 32 could both achieve good performance successfully.

FIG. 3C, FIG. 3D, FIG. 3E, FIG. 3F, FIG. 3G, FIG. 3H, FIG. 3I are respectively 2D radiation pattern curve diagrams of each of the first switches 3123, 3133 and each of the second switches 3223, 3233 of the highly integrated pattern-variable multi-antenna array 3 under different conditions of turn-on and turn-off according to an embodiment of the disclosure, in which a 2D radiation pattern curve 31122 of the first resonance mode and a 2D radiation pattern curve 32122 of the second resonance mode are shown. From FIG. 3C, FIG. 3D, FIG. 3E, FIG. 3F, FIG. 3G, FIG. 3H, FIG. 3I, it is clearly seen that the highly integrated pattern-variable multi-antenna array 3 could successfully achieve the technical effect of diversifying radiation pattern variations.

The operation of communication frequency band and experimental data covered by FIG. 3B, FIG. 3C, FIG. 3D, FIG. 3E, FIG. 3F, FIG. 3G, FIG. 3H, and FIG. 3I are only for the purpose of experimentally verifying the technical effects of the highly integrated pattern-variable multi-antenna array 3 of the embodiment of the disclosure shown in FIG. 3A, and are not used to limit communication frequency bands, applications, and specifications that may be covered by the highly integrated pattern-variable multi-antenna array 3 in practical applications. A single set or multiple sets of the highly integrated pattern-variable multi-antenna array 3 of the disclosure may be implemented in a communication device, where the first antenna array 31 and the second antenna array 32 may be arranged on the same side of the ground conductor structure 30, and the first antenna array 31 and the second antenna array 32 may also be arranged on adjacent different sides of the ground conductor structure 30. In addition, the communication device may be a mobile communication device, a wireless communication device, a mobile computing device, a computer system, telecommunications equipment, base station equipment, network equipment, or peripheral equipment of a computer or a network, etc.

Figure 4A:
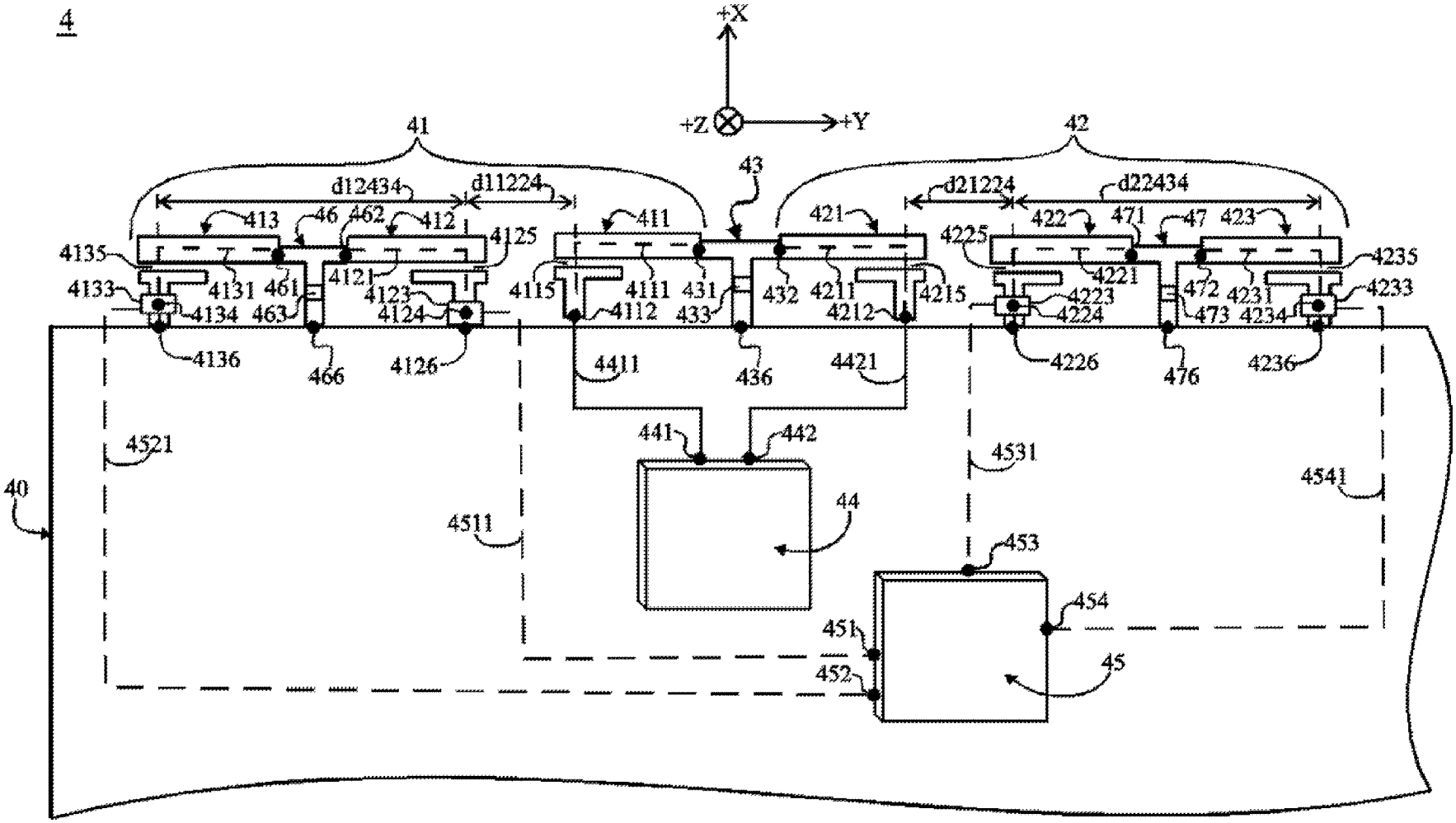
FIG. 4A is a structural diagram of a highly integrated pattern-variable multi-antenna array 4 according to an embodiment of the disclosure.
Figure 4B:
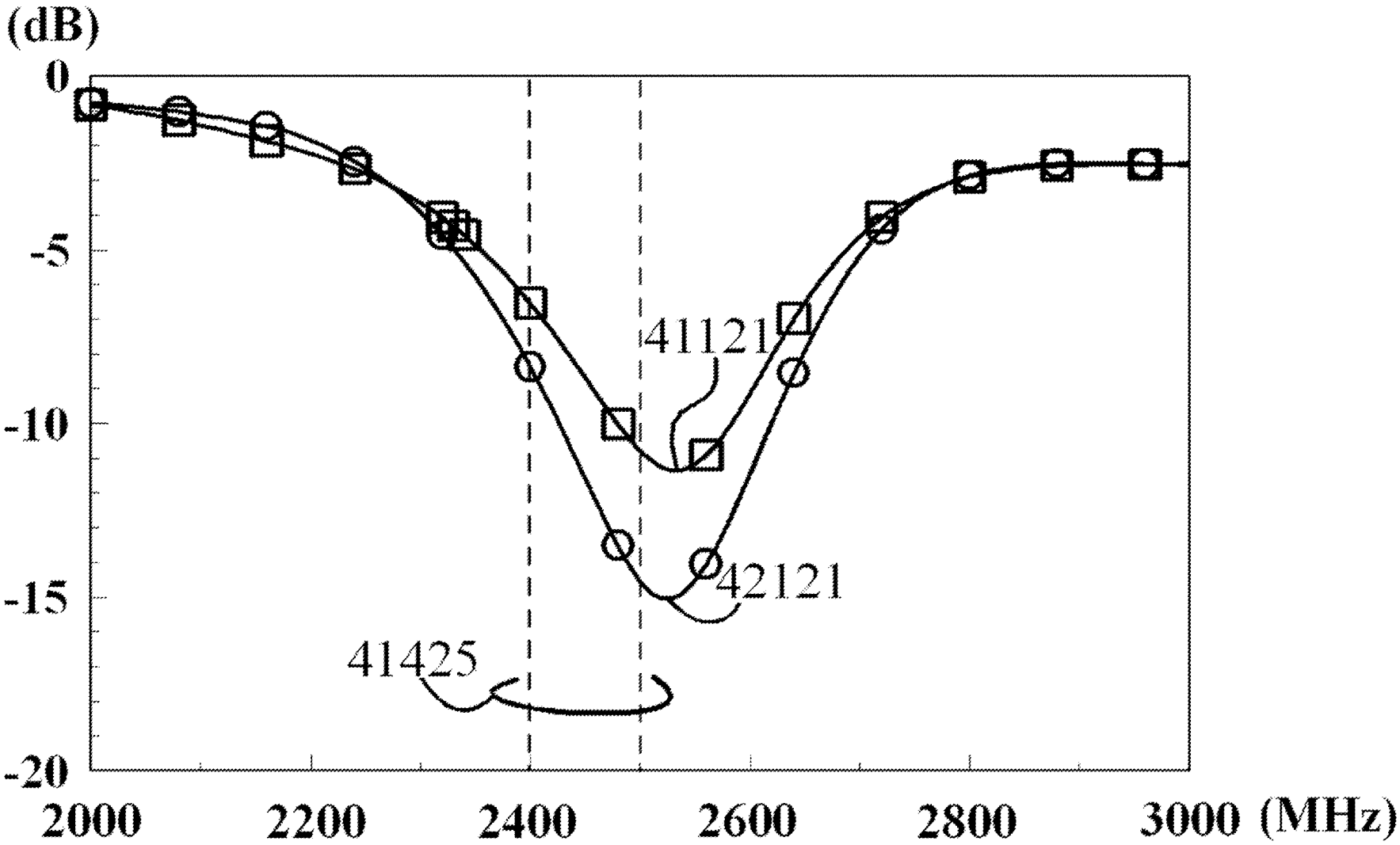
FIG. 4B is a return loss curve diagram of the highly integrated field variable multi-antenna array 4 according to an embodiment of the disclosure.
Figure 4C:
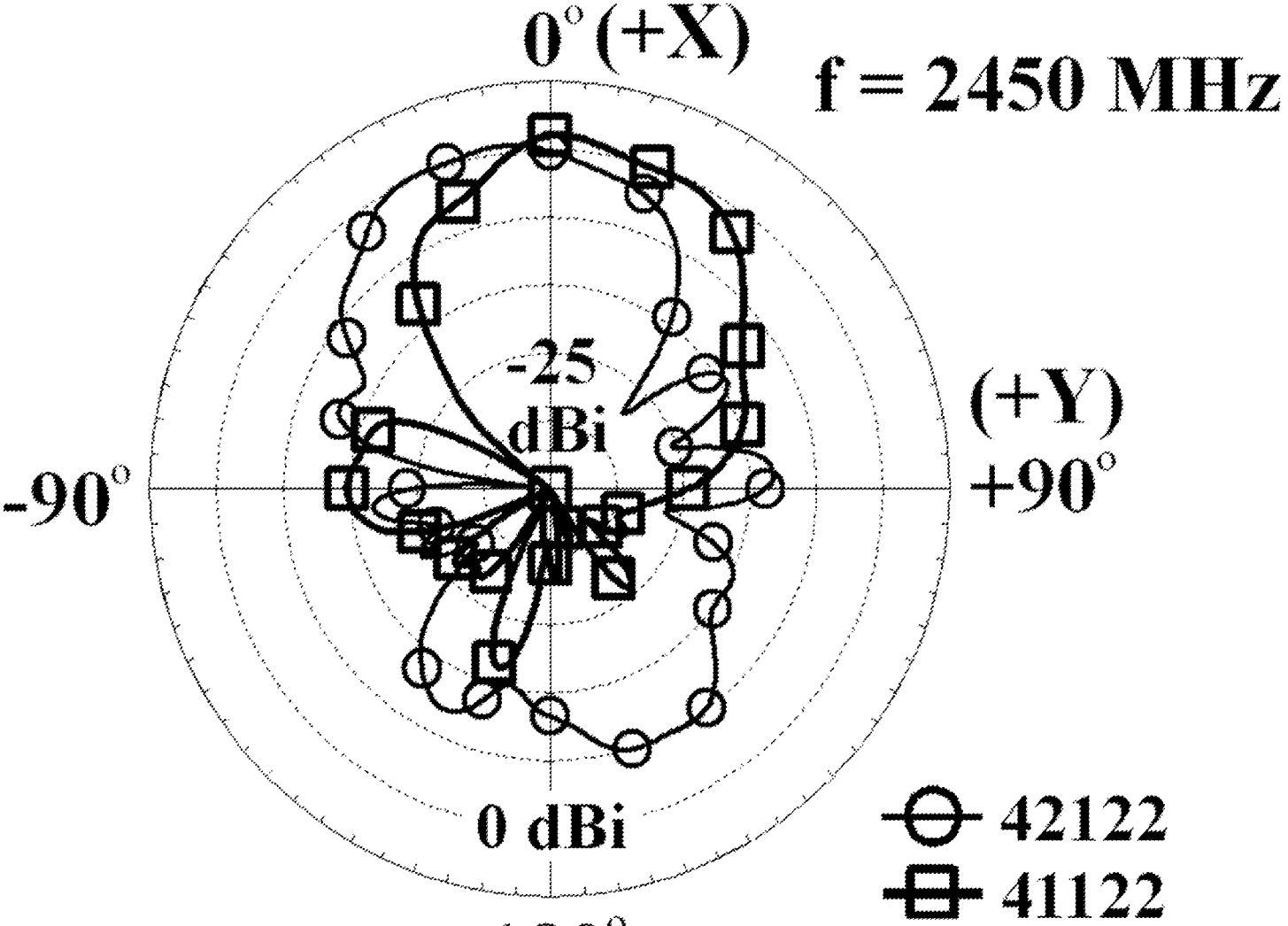
Figure 4D:
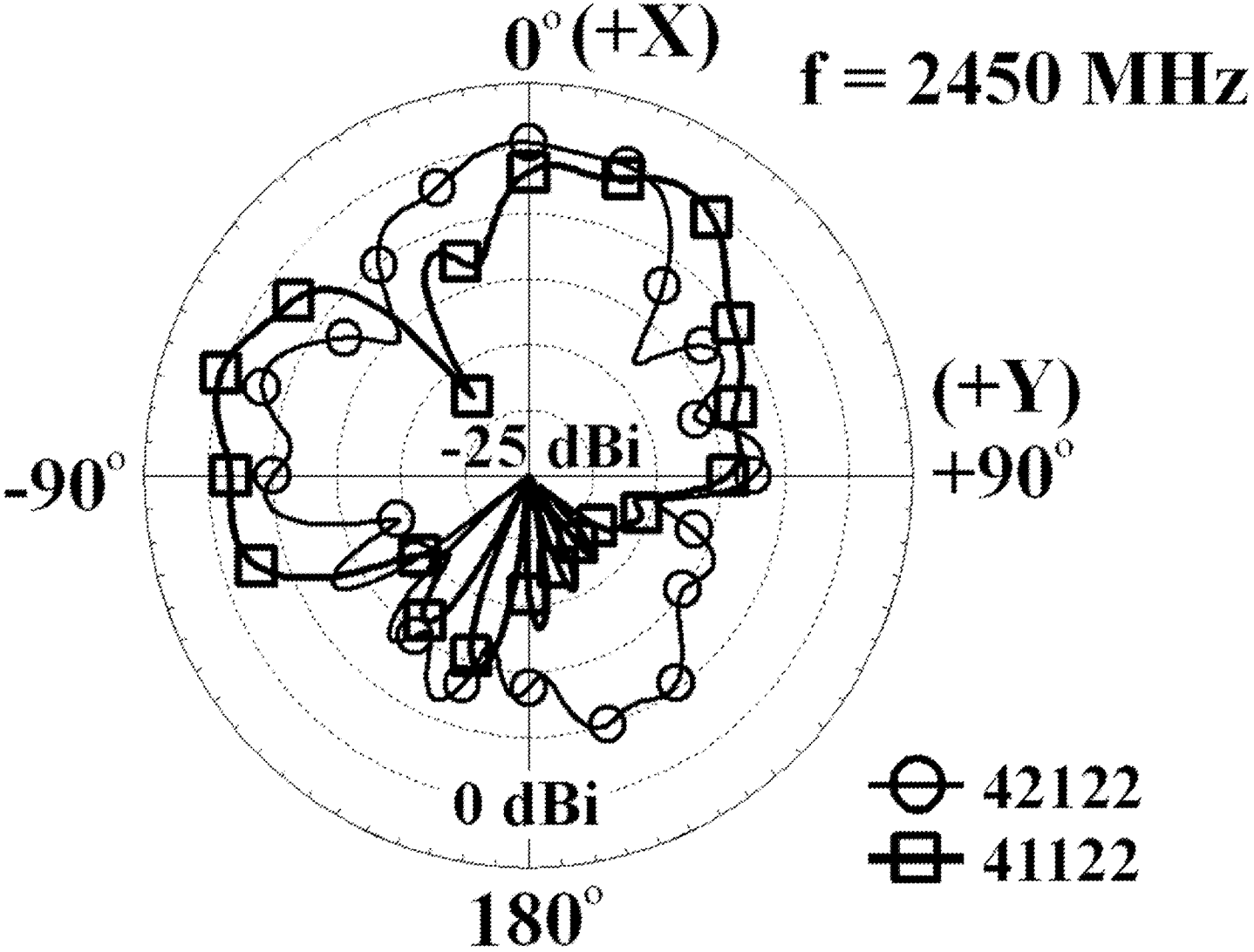
Figure 4E:
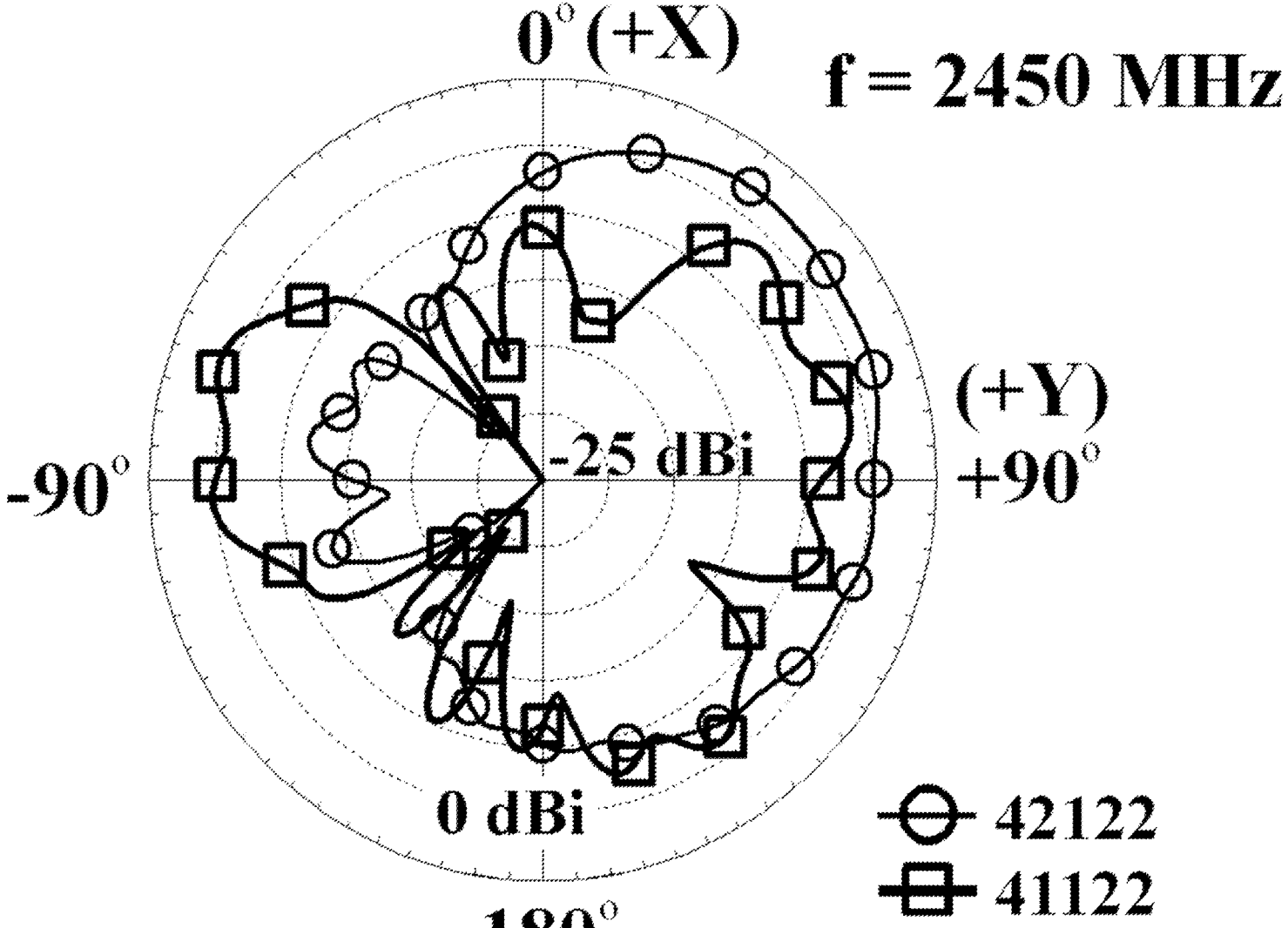
FIG. 4E is a 2D radiation pattern curve diagram of the highly integrated pattern-variable multi-antenna array 4 under a condition that the first switch 4123 is turned on, the first switch 4133 is turned off, the second switch 4223 is turned off and the second switch 4233 is turned off.
Figure 4F:
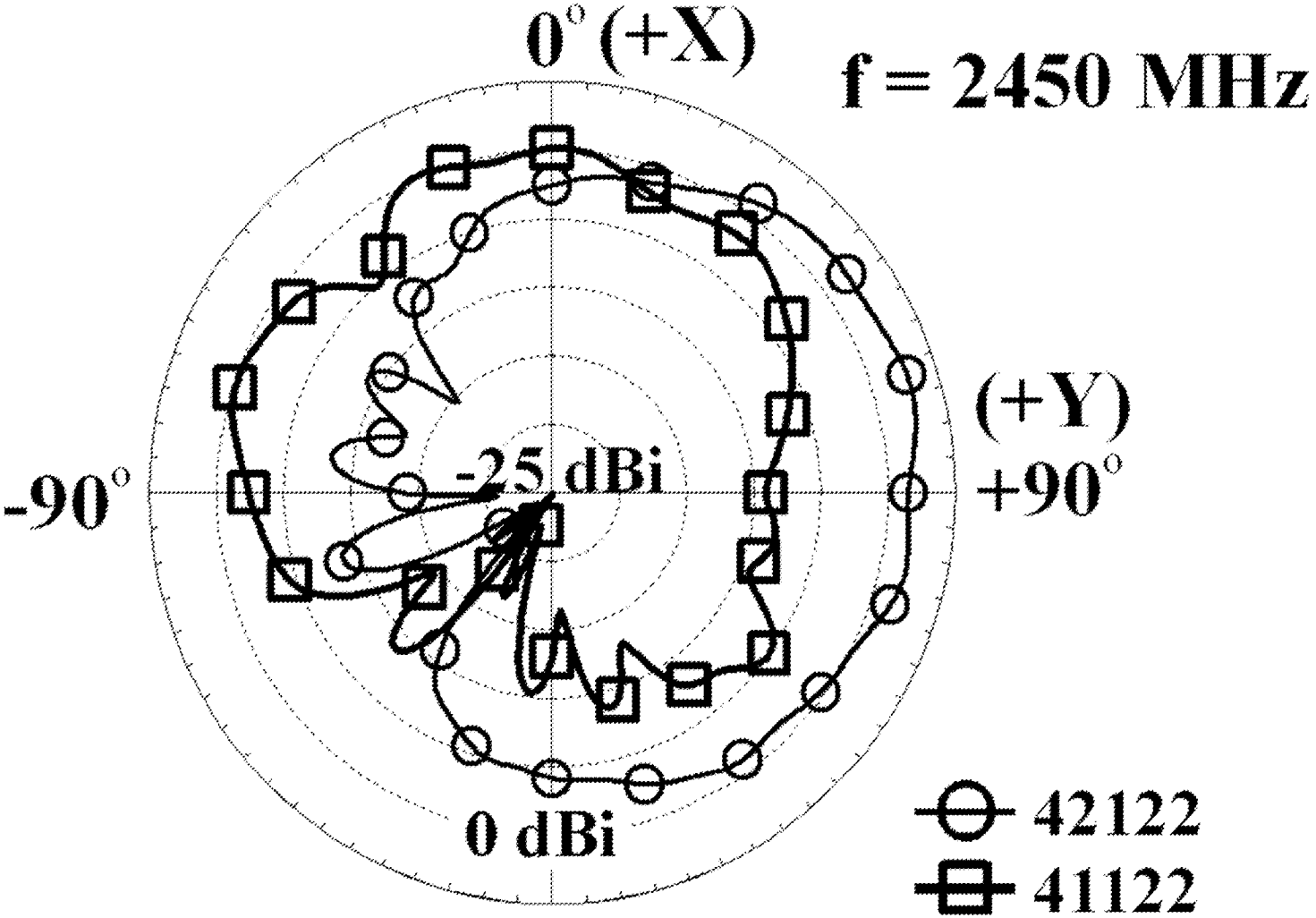
FIG. 4F is a 2D radiation pattern curve diagram of the highly integrated pattern-variable multi-antenna array 4 under a condition that the first switch 4123 is turned off, the first switch 4133 is turned on, the second switch 4223 is turned off and the second switch 4233 is turned off.
Figure 4G:
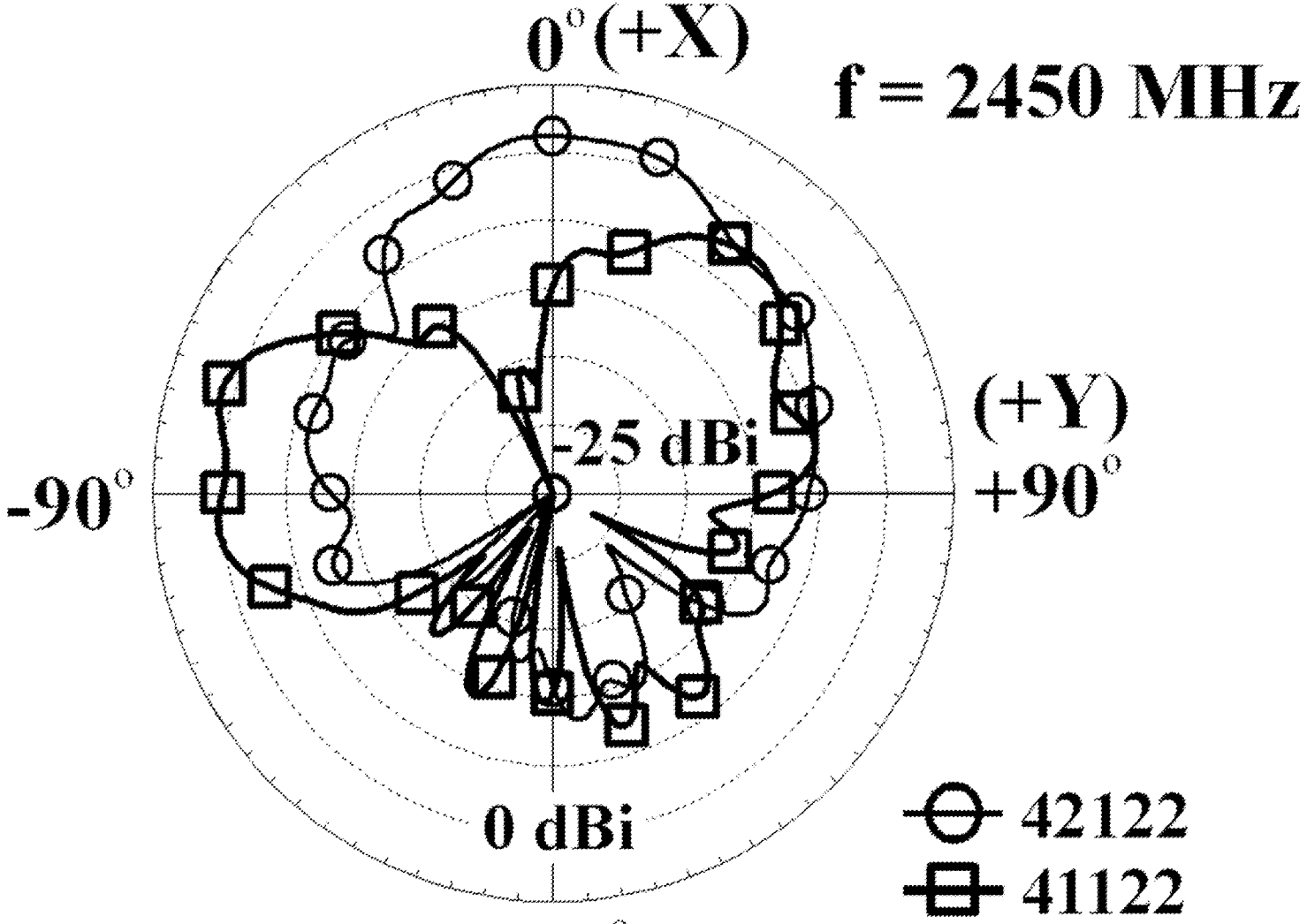
Figure 4H:
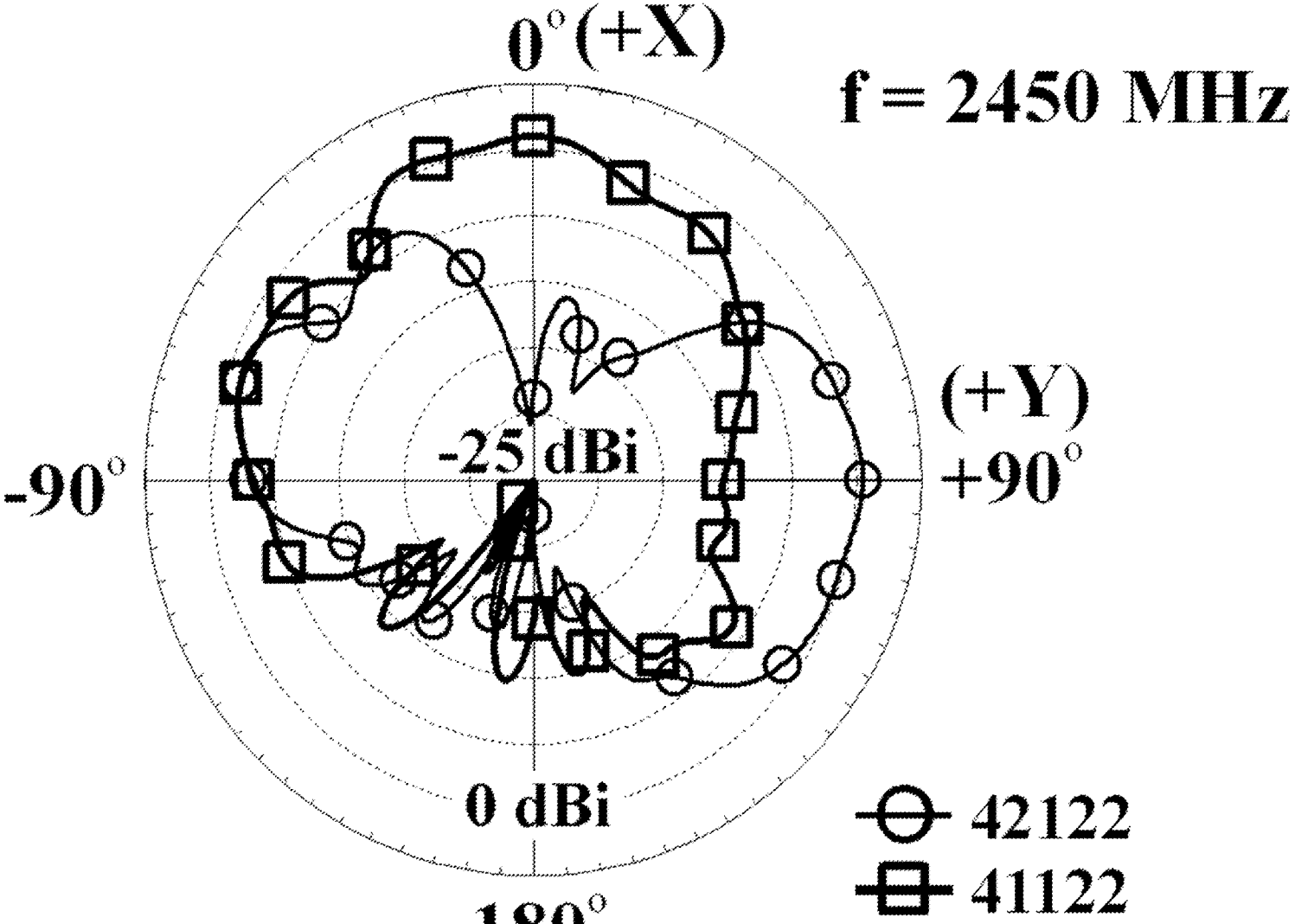
FIG. 4H is a 2D radiation pattern curve diagram of the highly integrated pattern-variable multi-antenna array 4 under a condition that the first switch 4123 is turned off, the first switch 4133 is turned on, the second switch 4223 is turned on and the second switch 4233 is turned off.
Figure 4I:
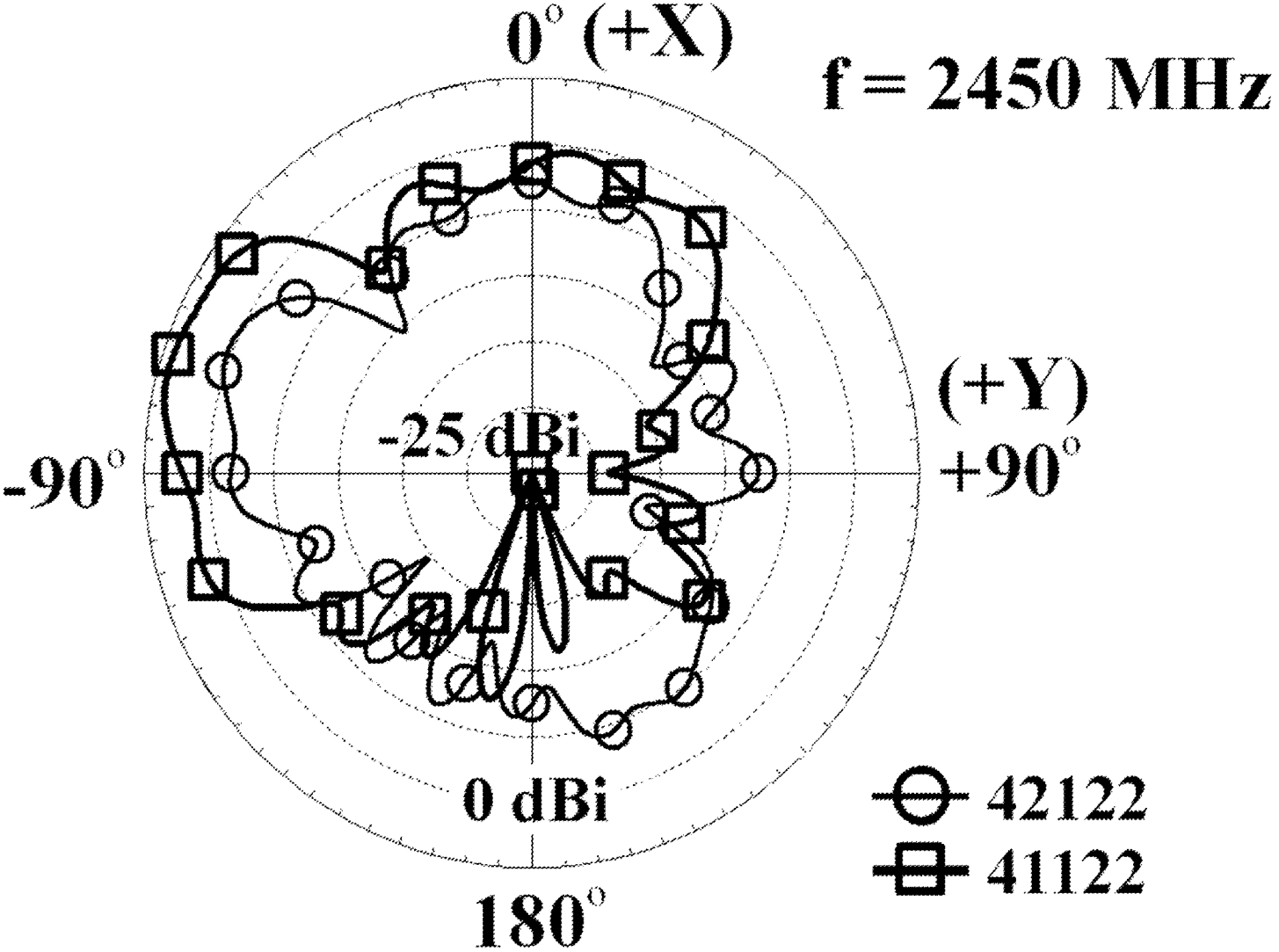

FIG. 4A is a structural diagram of a highly integrated pattern-variable multi-antenna array 4 according to an embodiment of the disclosure. FIG. 4B is a return loss curve diagram of the highly integrated field variable multi-antenna array 4 according to an embodiment of the disclosure. FIG. 4C, FIG. 4D, FIG. 4E, FIG. 4F, FIG. 4G, FIG. 4H, FIG. 4I are respectively 2D radiation pattern curve diagrams of the highly integrated pattern-variable multi-antenna array 4 under different turn-on and turn-off conditions of each of first switches 4123, 4133 and each of second switches 4223, 4233 according to an embodiment of the disclosure. As shown in FIG. 4A and FIG. 4B, the highly integrated pattern-variable multi-antenna array 4 includes a ground conductor structure 40, a first antenna array 41, a second antenna array 42 and an array conjoined grounding structure 43. The first antenna array 41 includes a plurality of first inverted L-shaped resonant structures 411, 412, and 413. The first inverted L-shaped resonant structures 411, 412, and 413 respectively have first resonance paths 4111, 4121, 4131. The first inverted L-shaped resonant structure 411 has a first feeding point 4112, and the other first inverted L-shaped resonant structures 412 and 413 respectively have first switches 4123, 4133, and are electrically connected or coupled to the ground conductor structure 40, and have electrical connection points 4126 and 4136. The first switches 4123, 4133 respectively have first switch center points 4124, 4134. The first antenna array 41 generates a first resonance mode 41121 (shown in FIG. 4B). The first inverted L-shaped resonant structures 411, 412, and 413 respectively have first capacitive structures 4115, 4125, 4135. Each of the first capacitive structures 4115, 4125, 4135 is a slit coupling capacitor structure. The first antenna array 41 has a first conjoined grounding structure 46, and the first conjoined grounding structure 46 is electrically connected to two adjacent first inverted L-shaped resonant structures 412, 413, and has a first conjoined capacitive structure 463 electrically connected or coupled to the ground conductor structure 40, and has electrical connection points 461, 462, and 466. The second antenna array 42 includes a plurality of second inverted L-shaped resonant structures 421, 422, and 423. The second inverted L-shaped resonant structures 421, 422, and 423 respectively have second resonance paths 4211, 4221, 4231. The second inverted L-shaped resonant structure 421 has a second feeding point 4212, and the other second inverted L-shaped resonant structures 422 and 423 respectively have second switches 4223, 4233, and are electrically connected or coupled to the ground conductor structure 40, and have electrical connection points 4226 and 4236. The second switches 4223, 4233 respectively have second switch center points 4224, 4234. The second antenna array 42 generates a second resonance mode 42121 (shown in FIG. 4B). The second resonance mode 42121 and the first resonance mode 41121 cover at least one identical first communication frequency band 41425 (shown in FIG. 4B). The second inverted L-shaped resonant structures 421, 422, and 423 respectively have second capacitive structures 4215, 4225, 4235. Each of the second capacitive structures 4215, 4225, 4235 is a slit coupling capacitor structure. The second antenna array 42 has a second conjoined grounding structure 47, and the second conjoined grounding structure 47 is electrically connected to two adjacent second inverted L-shaped resonant structures 422, 423, and has a second conjoined capacitive structure 473 electrically connected or coupled to the ground conductor structure 40, and has electrical connection points 471, 472, and 476. The gap of each of the slit coupling capacitor structures of the first capacitive structures 4115, 4125, 4135 and the second capacitive structures 4215, 4225, 4235 is less than or equal to 0.02 wavelength of the lowest operating frequency of the first communication frequency band. The array conjoined grounding structure 43 has an array conjoined capacitive structure 433, and is electrically connected to the adjacent first inverted L-shaped resonant structure 411, the second inverted L-shaped resonant structure 421, and the ground conductor structure 40, the first inverted L-shaped resonant structure 411 has the first feeding point 4112, and the second inverted L-shaped resonant structure 421 has the second feeding point 4212. The array conjoined grounding structure 43 has electrical connection points 431, 432 and 436. The array conjoined capacitive structure 433 is a lumped capacitor element or a chip capacitor element. The first inverted L-shaped resonant structures 411, 412, 413 or the second inverted L-shaped resonant structures 421, 422, 423 may also have partial turning or meandering sections to adjust an impedance matching level of the first resonance mode 41121 and the second resonance mode 42121.

There is a first distance d11224 between the first feeding point 4112 and the adjacent first switch center point 4124, and the first distance d11224 is between 0.05 wavelength and 0.6 wavelength of the lowest operating frequency of the first communication frequency band 41425. There is a second distance d12434 between the adjacent first switch center points 4124, 4134, and the second distance d12434 is between 0.05 wavelength and 0.5 wavelength of the lowest operating frequency of the first communication frequency band 41425. There is a third distance d21224 between the second feeding point 4212 and the adjacent second switch center point 4224, and the third distance d21224 is between 0.05 wavelength and 0.6 wavelength of the lowest operating frequency of the first communication frequency band 41425. There is a fourth distance d22434 between the adjacent second switch center points 4224, 4234, and the fourth distance d22434 is between 0.05 wavelength and 0.5 wavelength of the lowest operating frequency of the first communication frequency band 41425. The length of each of the first resonance paths 4111, 4121 and 4131 is between 0.1 wavelength and 0.5 wavelength of the lowest operating frequency of the first communication frequency band 41425. The length of each of the second resonance paths 4211, 4221 and 4231 is between 0.1 wavelength and 0.5 wavelength of the lowest operating frequency of the first communication frequency band 41425. The first switches 4123, 4133 and the second switches 4223 and 4233 may be respectively a diode switch, a mechanical switch, a semiconductor switch, a radio frequency switch, a microelectromechanical switch or a chip switch. The first feeding point 4112 and the second feeding point 4212 are electrically connected or coupled to a first circuit 44 through respective first transmission lines 4411, 4421, and have electrical connection points 441, 442. The first transmission lines 4411, 4421 may be respectively a radio frequency transmission line, a coaxial transmission line, a microstrip transmission line, a flat-plate transmission line or a strip line. The first circuit 44 excites the first antenna array 41 to generate the first resonance mode 41121 and excites the second antenna array 42 to generate the second resonance mode 42121 (as shown in FIG. 4B). The first circuit 44 may be a power combining circuit, a phase control circuit, a frequency up/down-conversion circuit, an impedance matching circuit, an amplifier module, an integrated circuit chip, a radio frequency module or a multi-input multi-output transceiver module. The first switches 4123, 4133 and the second switches 4223, 4233 are electrically connected or coupled to a second circuit 45 through respective second transmission lines 4511, 4521, 4531, 4541, and have electrical connection points 451, 452, 453 and 454. The second transmission lines 4511, 4521, 4531 and 4541 may be signal control lines, electric wires, conductor wires, conductor lines or enamelled wires. The second circuit 45 may control each of the first switches 4123 and 4133 and each of the second switches 4223 and 4233 to be in a turn-on or turn-off condition. The second circuit 45 may be an algorithm processing circuit, a switching control circuit, a microcontroller, a switch control module, or a signal processing integrated circuit chip.

In the highly integrated pattern-variable multi-antenna array 4 of an embodiment of the disclosure shown in FIG. 4A, arrangement directions and shapes of the first inverted L-shaped resonant structures 411, 412, 413 and the second inverted L-shaped resonant structures 421, 422, 423 are not completely the same to the arrangement directions and shapes of the first inverted L-shaped resonant structures 311, 312, 313 and the second inverted L-shaped resonant structures 321, 322, 323 of the highly integrated pattern-variable multi-antenna array 3. In addition, in the highly integrated pattern-variable multi-antenna array 4, the first inverted L-shaped resonant structures 411, 412, 413 are respectively configured with the first capacitor structures 4115, 4125, 4135, and the second inverted L-shaped resonant structures 421, 422, 423 are respectively configured with the second capacitor structures 4215, 4225, 4235. Moreover, the first antenna array 41 has the first conjoined grounding structure 46, and the second antenna array 42 has the second conjoined grounding structure 47, which are also different from the highly integrated pattern-variable multi-antenna array 3. However, in the highly integrated pattern-variable multi-antenna array 4, by designing the first inverted L-shaped resonant structures 412 and 413 to respectively have the first switches 4123, 4133 and to be electrically connected or coupled to the ground conductor structure 40, and designing the second inverted L-shaped resonant structures 422 and 423 to respectively have the second switches 4223, 4233 and to be electrically connected or coupled to the ground conductor structure 40, and changing each of the first switches 4123, 4133 and each of the second switches 4223, 4233 between different turn-on and turn-off state combinations, the effect of controlling the radiation pattern variations of the first antenna array 41 and the second antenna array 42 is successfully achieved. By designing the array conjoined grounding structure 43 to have the array conjoined capacitive structure 433, and to electrically connect the adjacent first inverted L-shaped resonant structure 411, the second inverted L-shaped resonant structure 421, and the ground conductor structure 40, an overall size of the first antenna array 41 and the second antenna array 42 is successfully reduced, and a mutual coupling effect between the first antenna array 41 and the second antenna array 42 is successfully reduced, and the mutual interference of each of the first switches 4123, 4133 and each of the second switches 4223, 4233 under different turn-on and turn-off state combinations is reduced, so as to successfully achieve the effect of generating diversified radiation patterns. In the highly integrated pattern-variable multi-antenna array 4, by designing the first distance d11224 between the first feeding point 4112 and the adjacent first switch center point 4124, where the first distance d11224 is between 0.05 wavelength and 0.6 wavelength of the lowest operating frequency of the first communication frequency band 41425, designing the second distance d12434 between the adjacent first switch center points 4124, 4134, where the second distance d12434 is between 0.05 wavelength and 0.5 wavelength of the lowest operating frequency of the first communication frequency band 41425, designing the third distance d21224 between the second feeding point 4212 and the adjacent second switch center point 4224, where the third distance d21224 is between 0.05 wavelength and 0.6 wavelength of the lowest operating frequency of the first communication frequency band 41425, and designing the fourth distance d22434 between the adjacent second switch center points 4224, 4234, where the fourth distance d22434 is between 0.05 wavelength and 0.5 wavelength of the lowest operating frequency of the first communication frequency band 41425, correlation of the radiation patterns between the first antenna array 41 and the second antenna array 42 is reduced, so as to successfully reduce the mutual interference between multiple data streams. In the highly integrated pattern-variable multi-antenna array 4, by designing the length of each of the first resonance paths 4111, 4121, 4131 to be between 0.1 wavelength and 0.5 wavelength of the lowest operating frequency of the first communication frequency band 41425, and designing the length of each of the second resonance paths 4211, 4221, 4231 to be between 0.1 wavelength and 0.5 wavelength of the lowest operating frequency of the first communication frequency band 41425, the effect that the first resonance mode 41121 generated by the first antenna array 41 and the second resonance mode 42121 generated by the second antenna array 42 have good impedance matching is achieved, and meanwhile the diversity of radiation pattern directivities of the first antenna array 41 and the second antenna array 42 in the first communication frequency band 41425 is improved. Therefore, the highly integrated pattern-variable multi-antenna array 4 of the embodiment of the disclosure may successfully achieve the technical effects of miniaturization, high integration, diversified radiation pattern variations, and multi-stream high-data-rate communication.

FIG. 4B is a return loss curve diagram of the highly integrated field variable multi-antenna array 4 according to an embodiment of the disclosure. Following sizes are selected for experiment: a length of the ground conductor structure is about 300 mm, and a width thereof is about 220 mm; lengths of the first resonance paths 4111, 4121, and 4131 are about 19.8 mm; the first distance d11224 is about 21.7 mm; the second distance d12434 is about 25 mm; lengths of the second resonance paths 4211, 4221, and 4231 are about 19.8 mm; the third distance d21224 is about 21.7 mm; the fourth distance d22434 is about 25 mm; a capacitance value of the array conjoined capacitive structure 433 is about 1 pF. As shown in FIG. 4B, the first antenna array 41 could successfully generate the first resonance mode 41121, the second antenna array 42 could successfully generate the second resonance mode 42121, and the first resonance mode 41121 and the second resonance mode 42121 cover the same first communication frequency band 41425 (2400 MHz-2500 MHz), and the lowest operating frequency of the first communication frequency band 41425 is 2400 MHz. The first resonance mode 41121 and the second resonance mode 42121 both achieve a good impedance matching in the first communication frequency band 41425. Therefore, it is verified that the first antenna array 41 and the second antenna array 42 could both achieve good performance successfully.

FIG. 4C, FIG. 4D, FIG. 4E, FIG. 4F, FIG. 4G, FIG. 4H, FIG. 4I are respectively 2D radiation pattern curve diagrams of each of the first switches 4123, 4133 and each of the second switches 4223, 4233 of the highly integrated pattern-variable multi-antenna array 4 under different conditions of turn-on and turn-off according to an embodiment of the disclosure, in which a 2D radiation pattern curve 41122 of the first resonance mode and a 2D radiation pattern curve 42122 of the second resonance mode are shown. From FIG. 4C, FIG. 4D, FIG. 4E, FIG. 4F, FIG. 4G, FIG. 4H, FIG. 4I, it is clearly seen that the highly integrated pattern-variable multi-antenna array 4 may successfully achieve the technical effect of diversifying radiation pattern variations.

The operation of communication frequency band and experimental data covered by FIG. 4B, FIG. 4C, FIG. 4D, FIG. 4E, FIG. 4F, FIG. 4G, FIG. 4H, and FIG. 4I are only for the purpose of experimentally verifying the technical effects of the highly integrated pattern-variable multi-antenna array 4 of the embodiment of the disclosure shown in FIG. 4A, and are not used to limit communication frequency bands, applications, and specifications that may be covered by the highly integrated pattern-variable multi-antenna array 4 in practical applications. A single set or multiple sets of the highly integrated pattern-variable multi-antenna array 4 of the disclosure may be implemented in a communication device, where the first antenna array 41 and the second antenna array 42 may be arranged on the same side of the ground conductor structure 40, and the first antenna array 41 and the second antenna array 42 may also be arranged on adjacent different sides of the ground conductor structure 30. In addition, the communication device may be a mobile communication device, a wireless communication device, a mobile computing device, a computer system, telecommunications equipment, base station equipment, network equipment, or peripheral equipment of a computer or a network, etc.

Figure 5:
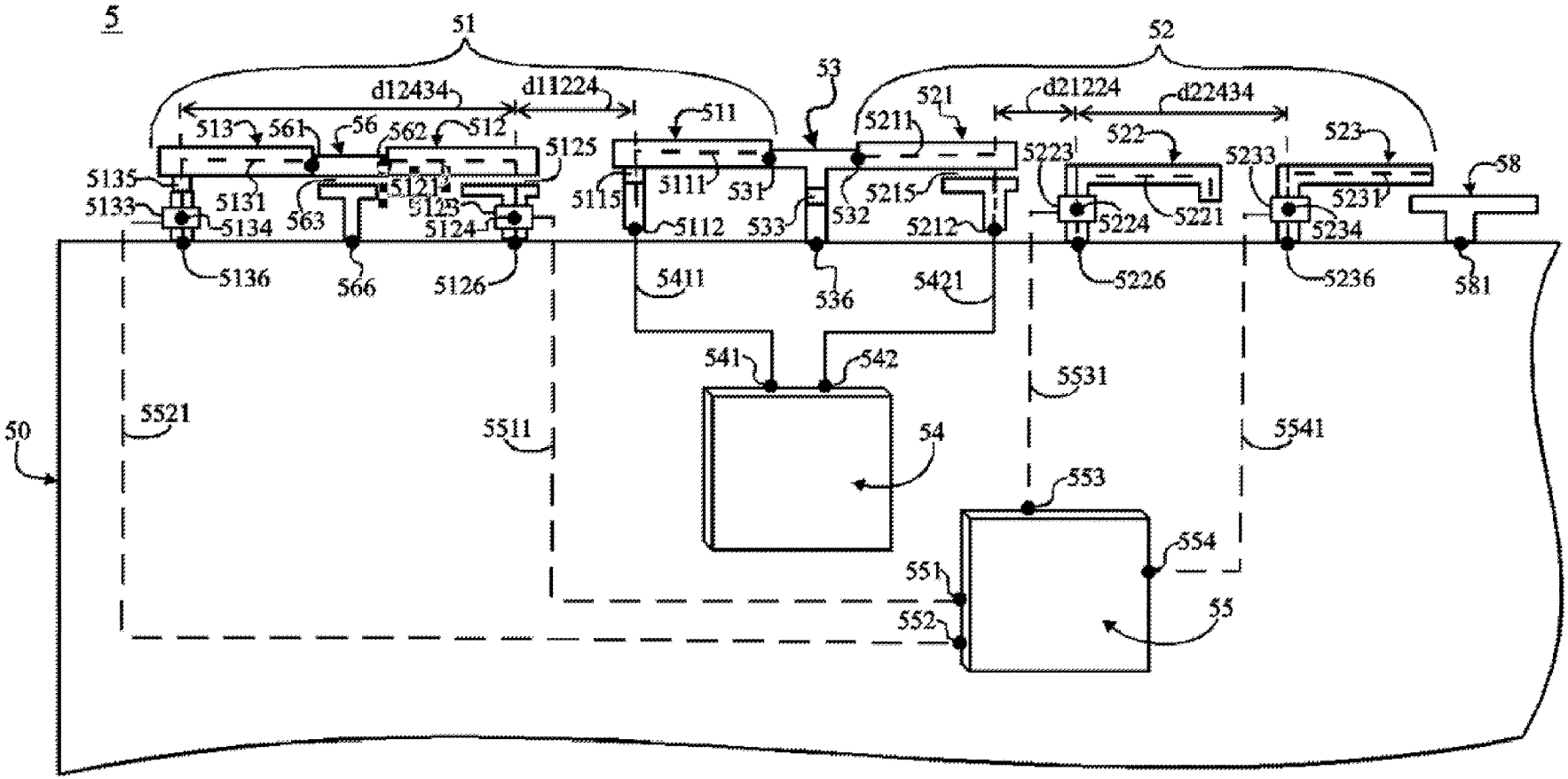
FIG. 5 is a structural diagram of a highly integrated pattern-variable multi-antenna array 5 according to an embodiment of the disclosure.

FIG. 5 is a structural diagram of a highly integrated pattern-variable multi-antenna array 5 according to an embodiment of the disclosure. As shown in FIG. 5, the highly integrated pattern-variable multi-antenna array 5 includes a ground conductor structure 50, a first antenna array 51, a second antenna array 52 and an array conjoined grounding structure 53. The first antenna array 51 includes a plurality of first inverted L-shaped resonant structures 511, 512, and 513. The first inverted L-shaped resonant structures 511, 512, and 513 respectively have first resonance paths 5111, 5121, 5131. The first inverted L-shaped resonant structure 511 has a first feeding point 5112, and the other first inverted L-shaped resonant structures 512 and 513 respectively have first switches 5123, 5133, and are electrically connected or coupled to the ground conductor structure 50, and have electrical connection points 5126 and 5136. The first switches 5123, 5133 respectively have first switch center points 5124, 5134. The first antenna array 51 generates a first resonance mode. The first inverted L-shaped resonant structures 511, 512, and 513 respectively have first capacitive structures 5115, 5125, 5135. The first capacitive structures 5115, 5135 are lumped capacitive elements or chip capacitive elements. The first capacitive structure 5125 is a slit coupling capacitor structure. The first antenna array 51 has a first conjoined grounding structure 56, and the first conjoined grounding structure 56 is electrically connected to two adjacent first inverted L-shaped resonant structures 512, 513, and has a first conjoined capacitive structure 563 electrically connected or coupled to the ground conductor structure 50, and has electrical connection points 561, 562, and 566. The first conjoined capacitive structure 563 is a slit coupling capacitor structure. The second antenna array 52 includes a plurality of second inverted L-shaped resonant structures 521, 522, and 523. The second inverted L-shaped resonant structures 521, 522, and 523 respectively have second resonance paths 5211, 5221, 5231. The second inverted L-shaped resonant structure 521 has a second feeding point 5212, and the other second inverted L-shaped resonant structures 522 and 523 respectively have second switches 5223, 5233, and are electrically connected or coupled to the ground conductor structure 50, and have electrical connection points 5226 and 5236. The second switches 5223, 5233 respectively have second switch center points 5224, 5234. The second antenna array 52 generates a second resonance mode. The second resonance mode and the first resonance mode cover at least one identical first communication frequency band. The second inverted L-shaped resonant structure 521 has the second capacitive structure 5215. The second capacitive structure 5215 is a slit coupling capacitor structure. The gaps of the slit coupling capacitor structures of the first capacitive structure 5125, the first conjoined capacitive structure 563, and the second capacitive structure 5215 are all less than or equal to 0.02 wavelength of the lowest operating frequency of the first communication frequency band. The highly integrated pattern-variable multi-antenna array 5 has a parasitic resonant structure 58, and the parasitic resonant structure 58 is disposed adjacent to the second inverted L-shaped resonant structure 523 and is electrically connected to the ground conductor structure 50, and has an electrical connection point 581. The array conjoined grounding structure 53 has an array conjoined capacitive structure 533, and is electrically connected to the adjacent first inverted L-shaped resonant structure 511, the second inverted L-shaped resonant structure 521, and the ground conductor structure 50, the first inverted L-shaped resonant structure 511 has the first feeding point 5112, and the second inverted L-shaped resonant structure 521 has the second feeding point 5212. The array conjoined grounding structure 53 has electrical connection points 531, 532 and 536. The array conjoined capacitive structure 533 is a lumped capacitor element or a chip capacitor element. The first inverted L-shaped resonant structures 511, 512, 513 or the second inverted L-shaped resonant structures 521, 522, 523 may also have partial turning or meandering sections to adjust an impedance matching level of the first resonance mode and the second resonance mode.

There is a first distance d11224 between the first feeding point 5112 and the adjacent first switch center point 5124, and the first distance d11224 is between 0.05 wavelength and 0.6 wavelength of the lowest operating frequency of the first communication frequency band. There is a second distance d12434 between the adjacent first switch center points 5124, 5134, and the second distance d12434 is between 0.05 wavelength and 0.5 wavelength of the lowest operating frequency of the first communication frequency band. There is a third distance d21224 between the second feeding point 5212 and the adjacent second switch center point 5224, and the third distance d21224 is between 0.05 wavelength and 0.6 wavelength of the lowest operating frequency of the first communication frequency band. There is a fourth distance d22434 between the adjacent second switch center points 5224, 5234, and the fourth distance d22434 is between 0.05 wavelength and 0.5 wavelength of the lowest operating frequency of the first communication frequency band. The length of each of the first resonance paths 5111, 5121 and 5131 is between 0.1 wavelength and 0.5 wavelength of the lowest operating frequency of the first communication frequency band. The length of each of the second resonance paths 5211, 5221 and 5231 is between 0.1 wavelength and 0.5 wavelength of the lowest operating frequency of the first communication frequency band. The first switches 5123, 5133 and the second switches 5223 and 5233 may be respectively a diode switch, a mechanical switch, a semiconductor switch, a radio frequency switch, a microelectromechanical switch or a chip switch. The first feeding point 5112 and the second feeding point 5212 are electrically connected or coupled to a first circuit 54 through respective first transmission lines 5411, 5421, and have electrical connection points 541, 542. The first transmission lines 5411, 5421 may be respectively a radio frequency transmission line, a coaxial transmission line, a microstrip transmission line, a flat-plate transmission line or a strip line. The first circuit 54 excites the first antenna array 51 to generate the first resonance mode and excites the second antenna array 52 to generate the second resonance mode. The first circuit 54 may be a power combining circuit, a phase control circuit, a frequency up/down-conversion circuit, an impedance matching circuit, an amplifier module, an integrated circuit chip, a radio frequency module or a multi-input multi-output transceiver module. The first switches 5123, 5133 and the second switches 5223, 5233 are electrically connected or coupled to a second circuit 55 through respective second transmission lines 5511, 5521, 5531, 5541, and have electrical connection points 551, 552, 553 and 554. The second transmission lines 5511, 5521, 5531 and 5541 may be signal control lines, electric wires, conductor wires, conductor lines or enamelled wires. The second circuit 55 may control each of the first switches 5123 and 5133 and each of the second switches 5223 and 5233 to be in a turn-on or turn-off condition. The second circuit 55 may be an algorithm processing circuit, a switching control circuit, a microcontroller, a switch control module, or a signal processing integrated circuit chip.

In the highly integrated pattern-variable multi-antenna array 5 of an embodiment of the disclosure shown in FIG.

5, arrangement directions and shapes of the second inverted L-shaped resonant structures 521, 522, 523 are not completely the same to the arrangement directions and shapes of the second inverted L-shaped resonant structures 421, 422, 423 of the highly integrated pattern-variable multi-antenna array 4. In addition, the first capacitive structures 5115, 5125, and 5135 are also not completely the same with the first capacitive structures 4115, 4125, and 4135 of the highly integrated pattern-variable multi-antenna array 4. The highly integrated pattern-variable multi-antenna array 5 has the parasitic resonant structure 58, and the second inverted L-shaped resonant structures 522 and 523 do not have a second conjoined grounding structure and a second capacitive structure, which is also different from the highly integrated pattern-variable multi-antenna array 4. However, in the highly integrated pattern-variable multi-antenna array 5, by designing the first inverted L-shaped resonant structures 512 and 513 to respectively have the first switches 5123, 5133 and to be electrically connected or coupled to the ground conductor structure 50, and designing the second inverted L-shaped resonant structures 522 and 523 to respectively have the second switches 5223, 5233 and to be electrically connected or coupled to the ground conductor structure 50, and changing the first switches 5123, 5133 and the second switches 5223, 5233 between different turn-on and turn-off state combinations, the effect of controlling the radiation pattern variations of the first antenna array 51 and the second antenna array 52 could also be successfully achieved. By designing the array conjoined grounding structure 53 to have the array conjoined capacitive structure 533, and to electrically connect the adjacent first inverted L-shaped resonant structure 511, the second inverted L-shaped resonant structure 521, and the ground conductor structure 50, an overall size of the first antenna array 51 and the second antenna array 52 could also be successfully reduced, and a mutual coupling effect between the first antenna array 51 and the second antenna array 52 would be successfully reduced, and the mutual interference of each of the first switches 5123, 5133 and each of the second switches 5223, 5233 under different turn-on and turn-off state combinations is reduced, so as to successfully achieve the effect of generating diversified radiation patterns. In the highly integrated pattern-variable multi-antenna array 5, by designing the first distance d11224 between the first feeding point 5112 and the adjacent first switch center point 5124, where the first distance d11224 is between 0.05 wavelength and 0.6 wavelength of the lowest operating frequency of the first communication frequency band, designing the second distance d12434 between the adjacent first switch center points 5124, 5134, where the second distance d12434 is between 0.05 wavelength and 0.5 wavelength of the lowest operating frequency of the first communication frequency band, designing the third distance d21224 between the second feeding point 5212 and the adjacent second switch center point 5224, where the third distance d21224 is between 0.05 wavelength and 0.6 wavelength of the lowest operating frequency of the first communication frequency band, and designing the fourth distance d22434 between the adjacent second switch center points 5224, 5234, where the fourth distance d22434 is between 0.05 wavelength and 0.5 wavelength of the lowest operating frequency of the first communication frequency band, correlation of the radiation patterns between the first antenna array 51 and the second antenna array 52 is reduced, so as to successfully reduce the mutual interference between multiple data streams. In the highly integrated pattern-variable multi-antenna array 5, by designing the length of each of the first resonance paths 5111, 5121, 5131 to be between 0.1 wavelength and 0.5 wavelength of the lowest operating frequency of the first communication frequency band, and designing the length of each of the second resonance paths 5211, 5221, 5231 to be between 0.1 wavelength and 0.5 wavelength of the lowest operating frequency of the first communication frequency band, the effect that the first resonance mode generated by the first antenna array 51 and the second resonance mode generated by the second antenna array 52 have good impedance matching is achieved, and meanwhile the diversity of radiation pattern directivities of the first antenna array 51 and the second antenna array 52 in the first communication frequency band would be increased. Therefore, the highly integrated pattern-variable multi-antenna array 5 of the embodiment of the disclosure could successfully achieve the technical effects of miniaturization, high integration, diversified radiation pattern variations, and multi-stream high-data-rate communication. A single set or multiple sets of the highly integrated pattern-variable multi-antenna array 5 of the disclosure may be implemented in a communication device, where the first antenna array 51 and the second antenna array 52 may be arranged on the same side of the ground conductor structure 50, and the first antenna array 51 and the second antenna array 52 may also be arranged on adjacent different sides of the ground conductor structure 50. In addition, the communication device may be a mobile communication device, a wireless communication device, a mobile computing device, a computer system, telecommunications equipment, base station equipment, network equipment, or peripheral equipment of a computer or a network, etc.

Figure 6:
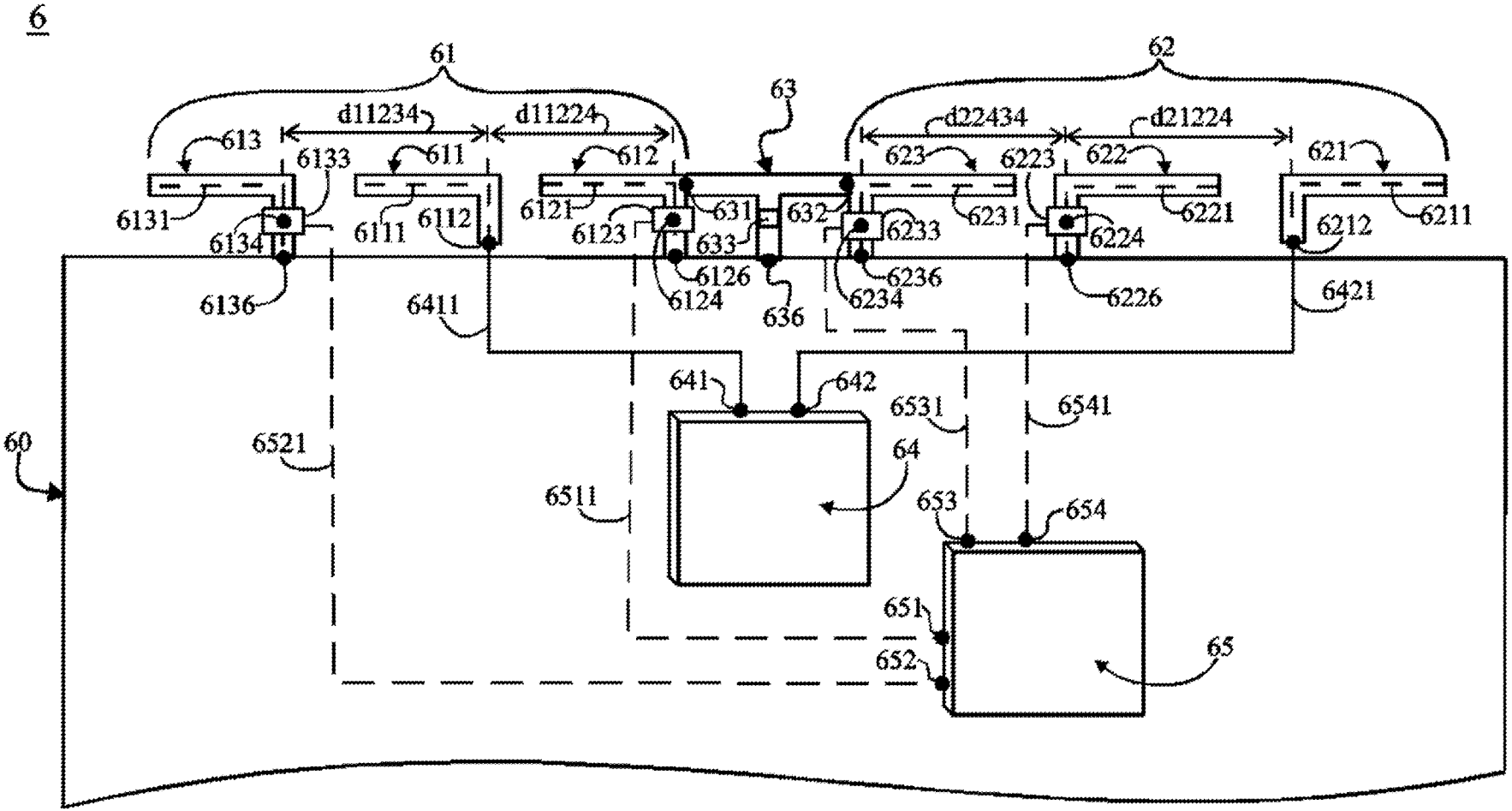
FIG. 6 is a structural diagram of a highly integrated pattern-variable multi-antenna array 6 according to an embodiment of the disclosure.

FIG. 6 is a structural diagram of a highly integrated pattern-variable multi-antenna array 6 according to an embodiment of the disclosure. As shown in FIG. 6, the highly integrated pattern-variable multi-antenna array 6 includes a ground conductor structure 60, a first antenna array 61, a second antenna array 62 and an array conjoined grounding structure 63. The first antenna array 61 includes a plurality of first inverted L-shaped resonant structures 611, 612, and 613. The first inverted L-shaped resonant structures 611, 612, and 613 respectively have first resonance paths 6111, 6121, 6131. The first inverted L-shaped resonant structure 611 has a first feeding point 6112, and the other first inverted L-shaped resonant structures 612 and 613 respectively have first switches 6123, 6133, and are electrically connected or coupled to the ground conductor structure 60, and have electrical connection points 6126 and 6136. The first switches 6123, 6133 respectively have first switch center points 6124, 6134. The first antenna array 61 generates a first resonance mode. The second antenna array 62 includes a plurality of second inverted L-shaped resonant structures 621, 622, and 623. The second inverted L-shaped resonant structures 621, 622, and 623 respectively have second resonance paths 6211, 6221, 6231. The second inverted L-shaped resonant structure 621 has a second feeding point 6212, and the other second inverted L-shaped resonant structures 622 and 623 respectively have second switches 6223, 6233, and are electrically connected or coupled to the ground conductor structure 60, and have electrical connection points 6226 and 6236. The second switches 6223, 6233 respectively have second switch center points 6224, 6234. The second antenna array 62 generates a second resonance mode. The second resonance mode and the first resonance mode cover at least one same first communication frequency band. The array conjoined grounding structure 63 has an array conjoined capacitive structure 633, and is electrically connected to the adjacent first inverted L-shaped resonant structure 612, the second inverted L-shaped resonant structure 623, and the ground conductor structure 60, the first inverted L-shaped resonant structure 612 has the first switch 6123 and is electrically connected or coupled to the ground conductor structure 60, and the second inverted L-shaped resonant structure 623 has the first switch 6233 and is electrically connected or coupled to the ground conductor structure 60. The array conjoined grounding structure 63 has electrical connection points 631, 632 and 636. The array conjoined capacitive structure 633 is a lumped capacitor element or a chip capacitor element. The first inverted L-shaped resonant structures 611, 612, 613 or the second inverted L-shaped resonant structures 621, 622, 623 may also have partial turning or meandering sections to adjust an impedance matching level of the first resonance mode and the second resonance mode.

There are first distances d11224, d11234 respectively between the first feeding point 6112 and the adjacent first switch center points 6124, 6134, and each of the first distances d11224, d11234 is between 0.05 wavelength and 0.6 wavelength of the lowest operating frequency of the first communication frequency band. There is a third distance d21224 between the second feeding point 6212 and the adjacent second switch center point 6224, and the third distance d21224 is between 0.05 wavelength and 0.6 wavelength of the lowest operating frequency of the first communication frequency band. There is a fourth distance d22434 between the adjacent second switch center points 6224, 6234, and the fourth distance d22434 is between 0.05 wavelength and 0.5 wavelength of the lowest operating frequency of the first communication frequency band. The length of each of the first resonance paths 6111, 6121 and 6131 is between 0.1 wavelength and 0.5 wavelength of the lowest operating frequency of the first communication frequency band. The length of each of the second resonance paths 6211, 6221 and 6231 is between 0.1 wavelength and 0.5 wavelength of the lowest operating frequency of the first communication frequency band. The first switches 6123, 6133 and the second switches 6223 and 6233 may be respectively a diode switch, a mechanical switch, a semiconductor switch, a radio frequency switch, a microelectromechanical switch or a chip switch. The first feeding point 6112 and the second feeding point 6212 are electrically connected or coupled to a first circuit 64 through respective first transmission lines 6411, 6421, and have electrical connection points 641, 642. The first transmission lines 6411, 6421 may be respectively a radio frequency transmission line, a coaxial transmission line, a microstrip transmission line, a flat-plate transmission line or a strip line. The first circuit 64 excites the first antenna array 61 to generate the first resonance mode and excites the second antenna array 62 to generate the second resonance mode. The first circuit 64 may be a power combining circuit, a phase control circuit, a frequency up/down-conversion circuit, an impedance matching circuit, an amplifier module, an integrated circuit chip, a radio frequency module or a multi-input multi-output transceiver module. The first switches 6123, 6133 and the second switches 6223, 6233 are electrically connected or coupled to a second circuit 65 through respective second transmission lines 6511, 6521, 6531, 6541, and have electrical connection points 651, 652, 653 and 654. The second transmission lines 6511, 6521, 6531 and 6541 may be signal control lines, electric wires, conductor wires, conductor lines or enamelled wires. The second circuit 65 may control each of the first switches 6123 and 6133 and each of the second switches 6223 and 6233 to be in a turn-on or turn-off condition. The second circuit 65 may be an algorithm processing circuit, a switching control circuit, a microcontroller, a switch control module, or a signal processing integrated circuit chip.

In the highly integrated pattern-variable multi-antenna array 6 of an embodiment of the disclosure shown in FIG. 6, arrangement directions and shapes of the second inverted L-shaped resonant structures 621, 622, 623 are not completely the same to the arrangement directions and shapes of the second inverted L-shaped resonant structures 221, 222, 223 of the highly integrated pattern-variable multi-antenna array 2. In addition, the array conjoined capacitive structure 633 and the adjacent first inverted L-shaped resonant structure 612 and the second inverted L-shaped resonant structure 623 that are electrically connected to the array conjoined grounding structure 63 are also different from that of the highly integrated pattern-variable multi-antenna array 2. However, in the highly integrated pattern-variable multi-antenna array 6, by designing the first inverted L-shaped resonant structures 612 and 613 to respectively have the first switches 6123, 6133 and to be electrically connected or coupled to the ground conductor structure 60, and designing the second inverted L-shaped resonant structures 622 and 623 to respectively have the second switches 6223, 6233 and to be electrically connected or coupled to the ground conductor structure 60, and changing the first switches 6123, 6133 and the second switches 6223, 6233 between different turn-on and turn-off state combinations, the effect of controlling the radiation pattern variations of the first antenna array 61 and the second antenna array 62 could also be successfully achieved. By designing the array conjoined grounding structure 63 to have the array conjoined capacitive structure 633, and to electrically connect the adjacent first inverted L-shaped resonant structure 612, the second inverted L-shaped resonant structure 623, and the ground conductor structure 60, an overall size of the first antenna array 61 and the second antenna array 62 could also be successfully reduced, and a mutual coupling effect between the first antenna array 61 and the second antenna array 62 would be successfully reduced, and the mutual interference of each of the first switches 6123, 6133 and each of the second switches 6223, 6233 under different turn-on and turn-off state combinations is reduced, so as to successfully achieve the effect of generating diversified radiation patterns. In the highly integrated pattern-variable multi-antenna array 6, by designing the first distances d11224, d11234 respectively between the first feeding point 6112 and the adjacent first switch center points 6124, 6134, where the first distances d11224, d11234 are between 0.05 wavelength and 0.6 wavelength of the lowest operating frequency of the first communication frequency band, designing the third distance d21224 between the second feeding point 6212 and the adjacent second switch center point 6224, where the third distance d21224 is between 0.05 wavelength and 0.6 wavelength of the lowest operating frequency of the first communication frequency band, and designing the fourth distance d22434 between the adjacent second switch center points 6224, 6234, where the fourth distance d22434 is between 0.05 wavelength and 0.5 wavelength of the lowest operating frequency of the first communication frequency band, correlation of the radiation patterns between the first antenna array 61 and the second antenna array 62 is reduced, so as to successfully reduce the mutual interference between multiple data streams. In the highly integrated pattern-variable multi-antenna array 6, by designing the length of each of the first resonance paths 6111, 6121, 6131 to be between 0.1 wavelength and 0.5 wavelength of the lowest operating frequency of the first communication frequency band, and designing the length of each of the second resonance paths 6211, 6221, 6231 to be between 0.1 wavelength and 0.5 wavelength of the lowest operating frequency of the first communication frequency band, the effect that the first resonance mode generated by the first antenna array 61 and the second resonance mode generated by the second antenna array 62 have good impedance matching is achieved, and meanwhile the diversity of radiation pattern directivities of the first antenna array 61 and the second antenna array 62 in the first communication frequency band would be increased. Therefore, the highly integrated pattern-variable multi-antenna array 6 of the embodiment of the disclosure could successfully achieve the technical effects of miniaturization, high integration, diversified radiation pattern variations, and multi-stream high-data-rate communication. A single set or multiple sets of the highly integrated pattern-variable multi-antenna array 6 of the disclosure may be implemented in a communication device, where the first antenna array 61 and the second antenna array 62 may be arranged on the same side of the ground conductor structure 60, and the first antenna array 61 and the second antenna array 62 may also be arranged on adjacent different sides of the ground conductor structure 60. In addition, the communication device may be a mobile communication device, a wireless communication device, a mobile computing device, a computer system, telecommunications equipment, base station equipment, network equipment, or peripheral equipment of a computer or a network, etc.

Figure 7:
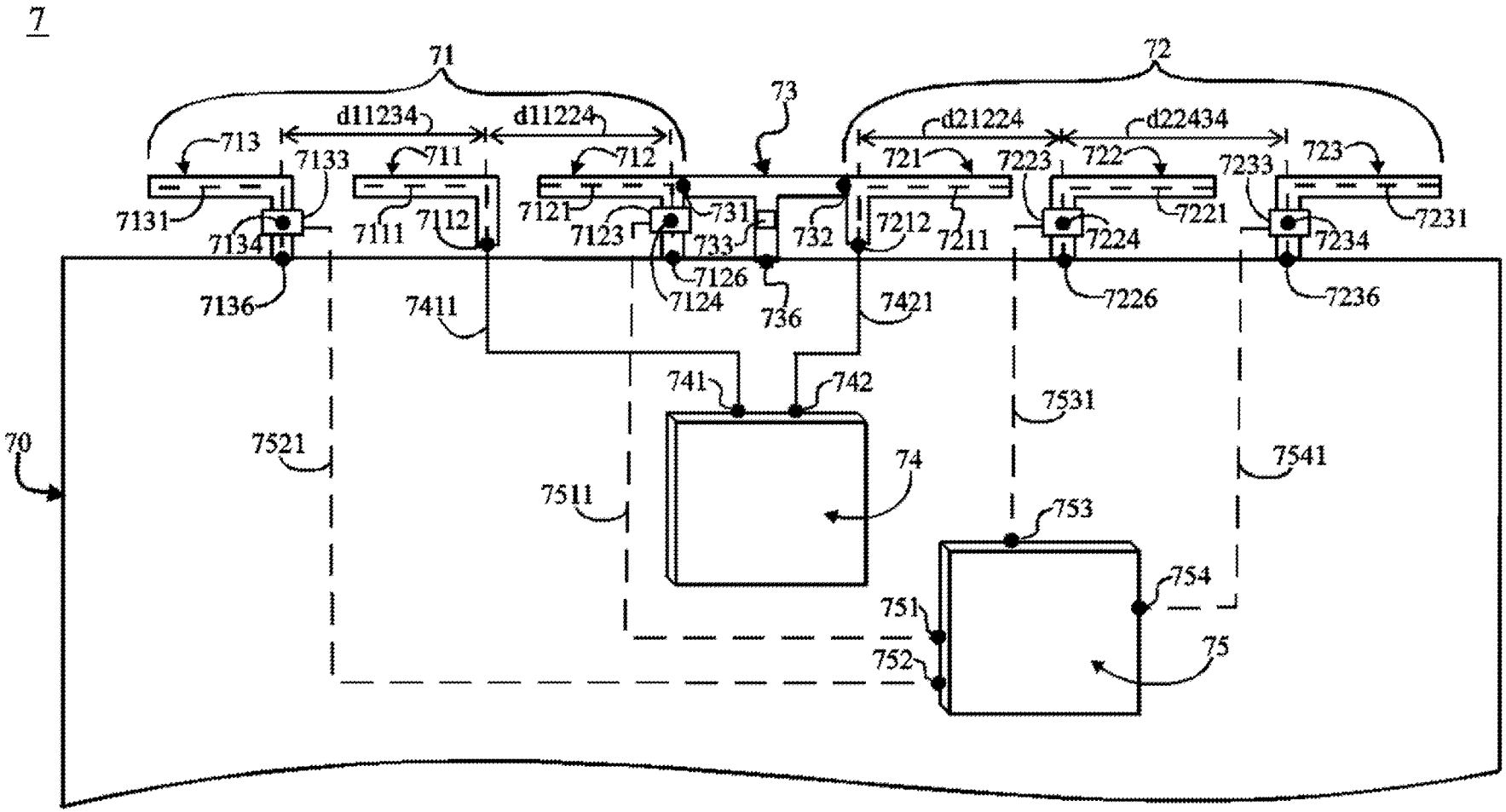
FIG. 7 is a structural diagram of a highly integrated pattern-variable multi-antenna array 7 according to an embodiment of the disclosure.

FIG. 7 is a structural diagram of a highly integrated pattern-variable multi-antenna array 7 according to an embodiment of the disclosure. As shown in FIG. 7, the highly integrated pattern-variable multi-antenna array 7 includes a ground conductor structure 70, a first antenna array 71, a second antenna array 72 and an array conjoined grounding structure 73. The first antenna array 71 includes a plurality of first inverted L-shaped resonant structures 711, 712, and 713. The first inverted L-shaped resonant structures 711, 712, and 713 respectively have first resonance paths 7111, 7121, 7131. The first inverted L-shaped resonant structure 711 has a first feeding point 7112, and the other first inverted L-shaped resonant structures 712 and 713 respectively have first switches 7123, 7133, and are electrically connected or coupled to the ground conductor structure 70, and have electrical connection points 7126 and 7136. The first switches 7123, 7133 respectively have first switch center points 7124, 7134. The first antenna array 71 generates a first resonance mode. The second antenna array 72 includes a plurality of second inverted L-shaped resonant structures 721, 722, and 723. The second inverted L-shaped resonant structures 721, 722, and 723 respectively have second resonance paths 7211, 7221, 7231. The second inverted L-shaped resonant structure 721 has a second feeding point 7212, and the other second inverted L-shaped resonant structures 722 and 723 respectively have second switches 7223, 7233, and are electrically connected or coupled to the ground conductor structure 70, and have electrical connection points 7226 and 7236. The second switches 7223, 7233 respectively have second switch center points 7224, 7234. The second antenna array 72 generates a second resonance mode. The second resonance mode and the first resonance mode cover at least one identical first communication frequency band. The array conjoined grounding structure 73 has an array conjoined capacitive structure 733, and is electrically connected to the adjacent first inverted L-shaped resonant structure 712, the second inverted L-shaped resonant structure 721, and the ground conductor structure 70, the first inverted L-shaped resonant structure 712 has the first switch 7123 and is electrically connected or coupled to the ground conductor structure 70, and the second inverted L-shaped resonant structure 721 has the second feeding point 7212. The array conjoined grounding structure 73 has electrical connection points 731, 732 and 736. The array conjoined capacitive structure 733 is a lumped capacitor element or a chip capacitor element. The first inverted L-shaped resonant structures 711, 712, 713 or the second inverted L-shaped resonant structures 721, 722, 723 may also have partial turning or meandering sections to adjust an impedance matching of the first resonance mode and the second resonance mode.

There are first distances d11224, d11234 respectively between the first feeding point 7112 and the adjacent first switch center points 7124, 7134, and each of the first distances d11224, d11234 is between 0.05 wavelength and 0.6 wavelength of the lowest operating frequency of the first communication frequency band. There is a third distance d21224 between the second feeding point 7212 and the adjacent second switch center point 7224, and the third distance d21224 is between 0.05 wavelength and 0.6 wavelength of the lowest operating frequency of the first communication frequency band. There is a fourth distance d22434 between the adjacent second switch center points 7224, 7234, and the fourth distance d22434 is between 0.05 wavelength and 0.5 wavelength of the lowest operating frequency of the first communication frequency band. The length of each of the first resonance paths 7111, 7121 and 7131 is between 0.1 wavelength and 0.5 wavelength of the lowest operating frequency of the first communication frequency band. The length of each of the second resonance paths 7211, 7221 and 7231 is between 0.1 wavelength and 0.5 wavelength of the lowest operating frequency of the first communication frequency band. The first switches 7123, 7133 and the second switches 7223 and 7233 may be respectively a diode switch, a mechanical switch, a semiconductor switch, a radio frequency switch, a microelectromechanical switch or a chip switch. The first feeding point 7112 and the second feeding point 7212 are electrically connected or coupled to a first circuit 74 through respective first transmission lines 7411, 7421, and have electrical connection points 741, 742. The first transmission lines 7411, 7421 may be respectively a radio frequency transmission line, a coaxial transmission line, a microstrip transmission line, a flat-plate transmission line or a strip line. The first circuit 74 excites the first antenna array 71 to generate the first resonance mode and excites the second antenna array 72 to generate the second resonance mode. The first circuit 74 may be a power combining circuit, a phase control circuit, a frequency up/down-conversion circuit, an impedance matching circuit, an amplifier module, an integrated circuit chip, a radio frequency module or a multi-input multi-output transceiver module. The first switches 7123, 7133 and the second switches 7223, 7233 are electrically connected or coupled to a second circuit 75 through respective second transmission lines 7511, 7521, 7531, 7541, and have electrical connection points 751, 752, 753 and 754. The second transmission lines 7511, 7521, 7531 and 7541 may be signal control lines, electric wires, conductor wires, conductor lines or enamelled wires. The second circuit 75 may control each of the first switches 7123 and 7133 and each of the second switches 7223 and 7233 to be in a turn-on or turn-off condition. The second circuit 75 may be an algorithm processing circuit, a switching control circuit, a microcontroller, a switch control module, or a signal processing integrated circuit chip.

In the highly integrated pattern-variable multi-antenna array 7 of an embodiment of the disclosure shown in FIG. 7, arrangement directions and shapes of the first inverted L-shaped resonant structures 711, 712, 713 and the second inverted L-shaped resonant structures 721, 722, 723 are not completely the same to the arrangement directions and shapes of the first inverted L-shaped resonant structures 211, 212, 213 and the second inverted L-shaped resonant structures 221, 222, 223 of the highly integrated pattern-variable multi-antenna array 2. In addition, the array conjoined capacitive structure 733 and the adjacent first inverted L-shaped resonant structure 712 and the second inverted L-shaped resonant structure 721 that are electrically connected to the array conjoined grounding structure 73 are also different from that of the highly integrated pattern-variable multi-antenna array 2. However, in the highly integrated pattern-variable multi-antenna array 7, by designing the first inverted L-shaped resonant structures 712 and 713 to respectively have the first switches 7123, 7133 and to be electrically connected or coupled to the ground conductor structure 70, and designing the second inverted L-shaped resonant structures 722 and 723 to respectively have the second switches 7223, 7233 and to be electrically connected or coupled to the ground conductor structure 70, and changing the first switches 7123, 7133 and the second switches 7223, 7233 between different turn-on and turn-off state combinations, the effect of controlling the radiation pattern variations of the first antenna array 71 and the second antenna array 72 could also be successfully achieved. By designing the array conjoined grounding structure 73 to have the array conjoined capacitive structure 733, and to electrically connect the adjacent first inverted L-shaped resonant structure 712, the second inverted L-shaped resonant structure 722, and the ground conductor structure 70, an overall size of the first antenna array 71 and the second antenna array 72 could also be successfully reduced, and a mutual coupling effect between the first antenna array 71 and the second antenna array 72 could also be successfully reduced, and the mutual interference of each of the first switches 7123, 7133 and each of the second switches 7223, 7233 under different turn-on and turn-off state combinations would be reduced, so as to successfully achieve the effect of generating diversified radiation patterns. In the highly integrated pattern-variable multi-antenna array 7, by designing the first distances d11224, d11234 respectively between the first feeding point 7112 and the adjacent first switch center points 7124, 7134, where the first distances d11224, d11234 are between 0.05 wavelength and 0.6 wavelength of the lowest operating frequency of the first communication frequency band, designing the third distance d21224 between the second feeding point 7212 and the adjacent second switch center point 7224, where the third distance d21224 is between 0.05 wavelength and 0.6 wavelength of the lowest operating frequency of the first communication frequency band, and designing the fourth distance d22434 between the adjacent second switch center points 7224, 7234, where the fourth distance d22434 is between 0.05 wavelength and 0.5 wavelength of the lowest operating frequency of the first communication frequency band, correlation of the radiation patterns between the first antenna array 71 and the second antenna array 72 would be reduced, so as to successfully reduce the mutual interference between multiple data streams. In the highly integrated pattern-variable multi-antenna array 7, by designing the length of each of the first resonance paths 7111, 7121, 7131 to be between 0.1 wavelength and 0.5 wavelength of the lowest operating frequency of the first communication frequency band, and designing the length of each of the second resonance paths 7211, 7221, 7231 to be between 0.1 wavelength and 0.5 wavelength of the lowest operating frequency of the first communication frequency band, the effect that the first resonance mode generated by the first antenna array 71 and the second resonance mode generated by the second antenna array 72 have good impedance matching could be achieved, and meanwhile the diversity of radiation pattern directivities of the first antenna array 71 and the second antenna array 72 in the first communication frequency band would be increased. Therefore, the highly integrated pattern-variable multi-antenna array 7 of the embodiment of the disclosure could successfully achieve the technical effects of miniaturization, high integration, diversified radiation pattern variations, and multi-stream high-data-rate communication. A single set or multiple sets of the highly integrated pattern-variable multi-antenna array 7 of the disclosure could be implemented in a communication device, where the first antenna array 71 and the second antenna array 72 could be arranged on the same side of the ground conductor structure 70, and the first antenna array 71 and the second antenna array 72 could also be arranged on adjacent different sides of the ground conductor structure 70. In addition, the communication device may be a mobile communication device, a wireless communication device, a mobile computing device, a computer system, telecommunications equipment, base station equipment, network equipment, or peripheral equipment of a computer or a network, etc.

The disclosure provides a highly integrated pattern-variable multi-antenna array design, which may meet practical application requirements of multi-antenna communication devices with high data transmission rate in the future.

It will be apparent to those skilled in the art that various modifications and variations could be made to the disclosed embodiments without departing from the scope or spirit of the disclosure. In view of the foregoing, it is intended that the disclosure covers modifications and variations provided they fall within the scope of the following claims and their equivalents.

What is claimed is:

1. A highly integrated pattern-variable multi-antenna array, comprising:

a ground conductor structure;

a first antenna array, comprising a plurality of first inverted L-shaped resonant structures, and each of the first inverted L-shaped resonant structures having a first resonance path, wherein one of the first inverted L-shaped resonant structures has a first feeding point, and each of the other first inverted L-shaped resonant structures has a first switch and is electrically connected or coupled to the ground conductor structure, the first switch has a first switch center point, and the first antenna array generates a first resonance mode;

a second antenna array, comprising a plurality of second inverted L-shaped resonant structures, and each of the second inverted L-shaped resonant structures having a second resonance path, wherein one of the second inverted L-shaped resonant structures has a second feeding point, and each of the other second inverted L-shaped resonant structures has a second switch and is electrically connected or coupled to the ground conductor structure, the second switch has a second switch center point, the second antenna array generates a second resonance mode, and the second resonance mode and the first resonance mode cover at least one identical first communication frequency band; and an array conjoined grounding structure, having an array conjoined capacitive structure and electrically connecting adjacent one of the first inverted L-shaped resonant structures, one of the second inverted L-shaped resonant structures, and the ground conductor structure.

2. The highly integrated pattern-variable multi-antenna array as claimed in claim 1, wherein there is a first distance between the first feeding point and the adjacent first switch center point, and the first distance is between 0.05 wavelength and 0.6 wavelength of the lowest operating frequency of the first communication frequency band.

3. The highly integrated pattern-variable multi-antenna array as claimed in claim 1, wherein there is a second distance between the adjacent first switch center points, and the second distance is between 0.05 wavelength and 0.5 wavelength of the lowest operating frequency of the first communication frequency band.

4. The highly integrated pattern-variable multi-antenna array as claimed in claim 1, wherein there is a third distance between the second feeding point and the adjacent second switch center point, and the third distance is between 0.05 wavelength and 0.6 wavelength of the lowest operating frequency of the first communication frequency band.

5. The highly integrated pattern-variable multi-antenna array as claimed in claim 1, wherein there is a fourth distance between the adjacent second switch center points, and the fourth distance is between 0.05 wavelength and 0.5 wavelength of a lowest operating frequency of the first communication frequency band.

6. The highly integrated pattern-variable multi-antenna array as claimed in claim 1, wherein the length of the first resonance path is between 0.1 wavelength and 0.5 wavelength of a lowest operating frequency of the first communication frequency band.

7. The highly integrated pattern-variable multi-antenna array as claimed in claim 1, wherein the length of the second resonance path is between 0.1 wavelength and 0.5 wavelength of a lowest operating frequency of the first communication frequency band.

8. The highly integrated pattern-variable multi-antenna array as claimed in claim 1, wherein the array conjoined grounding structure electrically connects adjacent one of the first inverted L-shaped resonant structures and one of the second inverted L-shaped resonant structures, the first inverted L-shaped resonant structure has the first feeding point, and the second inverted L-shaped resonant structure has the second feeding point.

9. The highly integrated pattern-variable multi-antenna array as claimed in claim 1, wherein the array conjoined grounding structure electrically connects adjacent one of the first inverted L-shaped resonant structures and one of the second inverted L-shaped resonant structures, the first inverted L-shaped resonant structure has the first switch and is electrically connected or coupled to the ground conductor structure, and the second inverted L-shaped resonant structure has the second feeding point.

10. The highly integrated pattern-variable multi-antenna array as claimed in claim 1, wherein the array conjoined grounding structure is electrically connected to adjacent one of the first inverted L-shaped resonant structures and one of the second inverted L-shaped resonant structures, the first inverted L-shaped resonant structure has the first switch and is electrically connected or coupled to the ground conductor structure, and the second inverted L-shaped resonant structure has the second switch and is electrically connected or coupled to the ground conductor structure.

11. The highly integrated pattern-variable multi-antenna array as claimed in claim 1, wherein the array conjoined capacitive structure is a lumped capacitive element, a chip capacitive element, or a slit coupling capacitive structure.

12. The highly integrated pattern-variable multi-antenna array as claimed in claim 1, wherein a part or all of the first inverted L-shaped resonant structures respectively have a first capacitive structure.

13. The highly integrated pattern-variable multi-antenna array as claimed in claim 12, wherein the first capacitive structure is a lumped capacitive element, a chip capacitive element, or a slit coupling capacitive structure.

14. The highly integrated pattern-variable multi-antenna array as claimed in claim 1, wherein a part or all of the second inverted L-shaped resonant structures respectively have a second capacitive structure.

15. The highly integrated pattern-variable multi-antenna array as claimed in claim 14, wherein the second capacitive structure is a lumped capacitive element, a chip capacitive element, or a slit coupling capacitive structure.

16. The highly integrated pattern-variable multi-antenna array as claimed in claim 1, wherein the first switch is a diode switch, a mechanical switch, a semiconductor switch, a radio frequency switch, a microelectromechanical switch, or a chip switch.

17. The highly integrated pattern-variable multi-antenna array as claimed in claim 1, wherein the second switch is a diode switch, a mechanical switch, a semiconductor switch, a radio frequency switch, a microelectromechanical switch, or a chip switch.

18. The highly integrated pattern-variable multi-antenna array as claimed in claim 1, wherein the first feeding point and the second feeding point are electrically connected or coupled to a first circuit through respective first transmission lines.

19. The highly integrated pattern-variable multi-antenna array as claimed in claim 18, wherein the first transmission line is a radio frequency transmission line, a coaxial transmission line, a microstrip transmission line, a flat-plate transmission line, or a strip line.

20. The highly integrated pattern-variable multi-antenna array as claimed in claim 18, wherein the first circuit is a power combining circuit, a phase control circuit, a frequency up/down-conversion circuit, an impedance matching circuit, an amplifier module, an integrated circuit chip, a radio frequency module, or a multi-input multi-output transceiver module.

21. The highly integrated pattern-variable multi-antenna array as claimed in claim 1, wherein each of the first switches and each of the second switches are electrically connected or coupled to a second circuit through respective second transmission lines.

22. The highly integrated pattern-variable multi-antenna array as claimed in claim 21, wherein the second transmission line is a signal control line, an electric wire, a conductor wire, or an enamelled wire.

23. The highly integrated pattern-variable multi-antenna array as claimed in claim 21, wherein the second circuit is an algorithm processing circuit, a switching control circuit, a microcontroller, a switch control module, or a signal processing integrated circuit chip.

24. The highly integrated pattern-variable multi-antenna array as claimed in claim 1, wherein the first antenna array has a first conjoined grounding structure, and the first conjoined grounding structure electrically connects two adjacent ones of the first inverted L-shaped resonant structures and has a first conjoined capacitive structure electrically connecting or coupling to the ground conductor structure.

25. The highly integrated pattern-variable multi-antenna array as claimed in claim 24, wherein the first conjoined capacitive structure is a lumped capacitive element, a chip capacitive element, or a slit coupling capacitive structure.

26. The highly integrated pattern-variable multi-antenna array as claimed in claim 24, wherein the two adjacent ones of the first inverted L-shaped resonant structures respectively have a first switch and respectively electrically connect or couple to the ground conductor structure.

27. The highly integrated pattern-variable multi-antenna array as claimed in claim 1, wherein the second antenna array has a second conjoined grounding structure, and the second conjoined grounding structure electrically connects two adjacent ones of the second inverted L-shaped resonant structures and has a second conjoined capacitive structure electrically connecting or coupling to the ground conductor structure.

28. The highly integrated pattern-variable multi-antenna array as claimed in claim 27, wherein the second conjoined capacitive structure is a lumped capacitive element, a chip capacitive element, or a slit coupling capacitive structure.

29. The highly integrated pattern-variable multi-antenna array as claimed in claim 27, wherein the two adjacent ones of the second inverted L-shaped resonant structures respectively have a second switch and respectively electrically connect or couple to the ground conductor structure.

30. The highly integrated pattern-variable multi-antenna array as claimed in claim 1, wherein a part or all of the first inverted L-shaped resonant structures have partial turning or meandering sections.

31. The highly integrated pattern-variable multi-antenna array as claimed in claim 1, wherein a part or all of the second inverted L-shaped resonant structures have partial turning or meandering sections.

* * * * *